US010940688B2

(12) United States Patent
Menzel et al.

(10) Patent No.: US 10,940,688 B2
(45) Date of Patent: Mar. 9, 2021

(54) ACTUATORS FOR FLUID DELIVERY SYSTEMS

(71) Applicant: FUJIFILM Dimatix, Inc., Lebanon, NH (US)

(72) Inventors: Christoph Menzel, New London, NH (US); Shinya Sugimoto, San Jose, CA (US); Mats G. Ottoson, Saltsjo-Boo (SE); Wayne Liu, San Jose, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

(21) Appl. No.: 16/560,284

(22) Filed: Sep. 4, 2019

(65) Prior Publication Data

US 2020/0001607 A1 Jan. 2, 2020

Related U.S. Application Data

(63) Continuation of application No. 15/845,371, filed on Dec. 18, 2017, now Pat. No. 10,406,811.
(Continued)

(51) Int. Cl.
*B41J 2/14* (2006.01)
*B41J 2/045* (2006.01)
(Continued)

(52) U.S. Cl.
CPC ..... *B41J 2/14233* (2013.01); *B41J 2/04533* (2013.01); *B41J 2/14032* (2013.01);
(Continued)

(58) Field of Classification Search
CPC ..... B41J 2/04533; B41J 2/14032; B41J 2/14233; B41J 2/161; B41J 2/1626;
(Continued)

(56) References Cited

U.S. PATENT DOCUMENTS 4,680,595 A 7/1987 Cruz-Uribe et al.
5,255,016 A 10/1993 Usui et al.
(Continued)

FOREIGN PATENT DOCUMENTS

CN 1320078 A 10/2001
CN 102218909 A 10/2011
(Continued)

OTHER PUBLICATIONS

PCT International Search Report and Written Opinion of the International Searching Authority, PCT/US17/67016, dated Mar. 13, 2018, 10 pages.
(Continued)

*Primary Examiner* — Anh T Vo
(74) *Attorney, Agent, or Firm* — Fish & Richardson P.C.

(57) ABSTRACT

An apparatus includes a reservoir and a printhead. The printhead includes a support structure including a deformable portion defining at least a top surface of a pumping chamber, a flow path extending from the reservoir to the pumping chamber to transfer fluid from the reservoir to the pumping chamber, and an actuator disposed on the deformable portion of the support structure. A trench is defined in a top surface of the actuator. Application of a voltage to the actuator causes the actuator to deform along the trench, thereby causing deformation of the deformable portion of the support structure to eject a drop of fluid from the pumping chamber.

27 Claims, 16 Drawing Sheets

Related U.S. Application Data

(60) Provisional application No. 62/436,276, filed on Dec. 19, 2016.

(51) Int. Cl.
*B41J 2/175* (2006.01)
*B41J 2/16* (2006.01)

(52) U.S. Cl.
CPC ..... *B41J 2/175* (2013.01); *B41J 2/17596* (2013.01); *B41J 2/04523* (2013.01); *B41J 2/1626* (2013.01); *B41J 2002/14258* (2013.01); *B41J 2002/14419* (2013.01); *B41J 2002/14459* (2013.01); *B41J 2002/14491* (2013.01); *B41J 2202/12* (2013.01)

(58) Field of Classification Search
CPC ..... B41J 2/175; B41J 2/17596; B41J 2002/14258; B41J 2002/14419; B41J 2002/14459; B41J 2002/14491; B41J 2202/12
See application file for complete search history.

(56) References Cited

U.S. PATENT DOCUMENTS

| | | | | |
|---|---|---|---|---|
| 5,814,922 | A | 9/1998 | Uchino et al. | |
| 5,831,651 | A | 11/1998 | Usui et al. | |
| 6,091,182 | A | 7/2000 | Takeuchi et al. | |
| 6,467,886 | B1 | 10/2002 | Takao et al. | |
| 6,688,732 | B2 | 2/2004 | Mitsuhashi et al. | |
| 8,544,157 | B2 * | 10/2013 | Sugahara | B41J 2/14233 29/25.35 |
| 2001/0055046 | A1 | 12/2001 | Tanaka | |
| 2005/0134144 | A1 * | 6/2005 | Buhler | B41J 2/14233 310/317 |
| 2006/0023032 | A1 | 2/2006 | Bibl et al. | |
| 2006/0044359 | A1 | 3/2006 | Sugahara | |
| 2007/0046736 | A1 | 3/2007 | Katayama et al. | |
| 2008/0239018 | A1 | 10/2008 | Sekiguchi | |
| 2010/0225709 | A1 | 9/2010 | Miura et al. | |
| 2013/0002768 | A1 * | 1/2013 | Miyazawa | B41J 2/14209 347/68 |
| 2014/0240404 | A1 | 8/2014 | Li et al. | |

FOREIGN PATENT DOCUMENTS

| | | | |
|---|---|---|---|
| CN | 103171285 | A | 6/2013 |
| CN | 105984223 | A | 10/2016 |
| JP | 2004209740 | A | 7/2004 |
| JP | 2008260195 | A | 10/2008 |
| WO | WO2007016237 | A1 | 2/2007 |

OTHER PUBLICATIONS

Extended European Search Report issued in European Application No. 17885073.1 dated Nov. 14, 2019, 8 pages.
Office Action issued in Chinese Application No. 201780078592.0 dated Sep. 2, 2020, 17 pages (with English translation).
EPO Communication pursuant to Article 94(3) EPC issued in European Application No. 17885073.1 dated Nov. 9, 2020, 4 pages.

* cited by examiner

ACTUATORS FOR FLUID DELIVERY SYSTEMS

CLAIM OF PRIORITY

This application is a continuation of U.S. patent application Ser. No. 15/845,371, filed Dec. 18, 2017, which claims the benefit of priority to U.S. Provisional Application No. 62/436,276, filed on Dec. 19, 2016. The entire contents of each of these applications are incorporated here by reference.

TECHNICAL FIELD

This specification relates to actuators for fluid delivery systems.

BACKGROUND

Ink jet printing can be performed using an ink jet print head that includes multiple nozzles. Ink is introduced into the ink jet printhead and, when activated, the nozzles eject droplets of ink to form an image on a substrate. The printhead can include fluid delivery systems with deformable actuators to eject fluid from a pumping chamber of the printhead. The actuators can be deformed to change a volume of a pumping chamber. As the actuators are driven, changes in the volume can cause fluid to be ejected from the fluid delivery system. The actuators, when deformed, can experience material stresses.

SUMMARY

In an aspect, a printhead includes a support structure comprising a deformable portion defining at least a top surface of a pumping chamber; and an actuator disposed on the deformable portion of the support structure, wherein a trench is defined in a top surface of the actuator.

Embodiments can include one or more of the following features.

Application of a voltage to the actuator causes the actuator to deform along the trench, thereby causing deformation of the deformable portion to eject a drop of fluid from the pumping chamber.

The actuator comprises first and second electrodes and a piezoelectric layer between the first and second electrodes, and the printhead comprises a controller to apply a voltage to one of the first and second electrodes to deform the deformable portion.

The controller is configured to apply the voltage to the one of the first and second electrodes such that the deformable portion deforms away from the pumping chamber.

The trench extends radially outwardly away from a central region of the top surface of the actuator.

The printhead includes multiple radial trenches each extending radially outward away from a central region of the top surface of the actuator.

Each of the radial trenches is oriented perpendicular to the trench at a point where the radial trench meets the trench.

A distance between the trench and a perimeter of the deformable portion is greater than a distance between the trench and a central region of the top surface of the deformable portion.

A distance between the trench and a perimeter of the deformable portion is less than a distance between the trench and a central region of the top surface of the deformable portion.

A distance between the trench and a perimeter of the deformable portion of the support structure is 20% and 80% of the distance between a center of the deformable portion and the perimeter of the deformable portion.

The trench extends along the top surface of the actuator such that the trench is offset inwardly from a perimeter of the deformable portion.

The trench defines at least a portion of a loop offset inwardly from a portion of a perimeter of the deformable portion.

The trench is a first trench, and further comprising a second trench defined in the top surface of the actuator, the second trench extending radially outward from the first trench.

A first end of the second trench is connected to the first trench and a second end of the second trench is connected to a third trench defined in the top surface of the actuator, wherein the third trench has a rounded shape.

A width of the trench is between 0.1 micrometers and 10 micrometers.

The trench defines a curve having a first end and a second end, the curve offset inwardly from a portion of a perimeter of the deformable portion.

The trench extends through the thickness of the actuator from the top surface of the actuator to a top surface of the deformable portion of the support structure.

The deformable portion comprises an oxide layer, and the trench extends to a top surface of the oxide layer.

The trench overlaps with at least a portion of a perimeter of the deformable portion.

The trench is a first trench defining at least a portion of a first loop, and wherein a second trench is formed in the top surface of the actuator, the second trench defining at least a portion of a second loop separated from the first loop.

The trench is a first trench, and wherein a second trench is formed in the top surface of the actuator further, the first trench and the second trench extending radially outward away from a central region of the top surface of the actuator and being parallel to one another.

The trench is a first trench, and wherein second and third trenches are formed in the top surface of the actuator, the first trench extending radially outward from a central region of the actuator and connecting the second trench to the third trench, and the second trench and the third trench extending circumferentially across the exterior surface.

The trench is a first trench extending radially outward away from a center of the actuator, the actuator further defines second, third, and fourth trenches, the second trench extending circumferentially across the exterior surface, the third trench extending radially outward away from the center of the actuator, and the fourth trench extending circumferentially across the exterior surface, and the first trench and the second trench are connected to one another, the third trench and the fourth trench are connected to one another, and the first and second trenches are separated from the third and fourth trenches.

In a general aspect, an apparatus includes a reservoir; and a printhead including a support structure comprising a deformable portion defining at least a top surface of a pumping chamber, a flow path extending from the reservoir to the pumping chamber to transfer fluid from the reservoir to the pumping chamber, and an actuator disposed on the deformable portion of the support structure, wherein a trench is defined in a top surface of the actuator, wherein application of a voltage to the actuator causes the actuator to deform along the trench, thereby causing deformation of the deformable portion of the support structure to eject a drop of fluid from the pumping chamber.

Embodiments can include one or more of the following features.

The actuator comprises first and second electrodes and a piezoelectric layer between the first and second electrodes, and the printhead comprises a controller to apply a voltage to one of the first and second electrodes to deform the deformable portion.

The controller is configured to apply the voltage to the one of the first and second electrodes such that the deformable portion deforms away from the pumping chamber.

The trench extends along the top surface of the actuator such that the trench is offset inwardly from a perimeter of the deformable portion.

The trench defines a curve having a first end and a second end, the curve offset inwardly from a portion of a perimeter of the deformable portion.

The trench defines at least a portion of a loop offset inwardly from a portion of a perimeter of the deformable portion.

The trench is a first trench, and further comprising a second trench defined in the top surface of the actuator, the second trench extending radially outward from the first trench.

The second trench comprises a first end connected to the first trench and a second end connected to a third trench, the third trench defining a rounded perimeter on the top surface of the actuator.

The trench extends radially outwardly away from a central region of the top surface of the actuator.

The apparatus includes multiple radial trenches each extending radially outward away from a central region of the top surface of the actuator.

A path of each of the radial trenches is perpendicular to the trench.

A distance between the trench and a perimeter of the deformable portion is less than a distance between the trench and a central region of a top surface of the actuator.

The trench extends through the thickness of the actuator from the top surface of the actuator to a top surface of the deformable portion of the support structure.

A width of the trench is between 0.1 micrometers and 10 micrometers.

A distance between the trench and a perimeter of the deformable portion is greater than a distance between the trench and a central region of a top surface of the actuator.

A distance between the trench and a perimeter of the deformable portion is 20% and 80% of the distance between a central region of a top surface of the actuator and the perimeter of the deformable portion.

The trench overlaps with a perimeter of the deformable portion.

The trench is a first trench defining at least a portion of a first loop, and wherein a second trench is formed in the top surface of the actuator, the second trench defining at least a portion of a second loop separated from the first loop.

The trench is a first trench, and wherein a second trench is formed in a top surface of the actuator, the first trench and the second trench extending radially outward away from a central region of the top surface of the actuator and being parallel to one another.

The trench is a first trench, and wherein second and third trenches are formed in the top surface of the actuator, the first trench extending radially outward from a central region of the top surface of the actuator and connecting the second trench to the third trench, and the second trench and the third trench extending circumferentially across the top surface of the actuator.

The trench is a first trench extending radially outward away from a central region of the top surface of the actuator, the actuator further defines second, third, and fourth trenches, the second trench extending circumferentially across the top surface of the actuator, the third trench extending radially outward away from the central region of the top surface of the actuator, and the fourth trench extending circumferentially across the top surface, and the first trench and the second trench are connected to one another, the third trench and the fourth trench are connected to one another, and the first and second trenches are separated from the third and fourth trenches.

In a general aspect, a method includes applying a voltage to an electrode of a piezoelectric actuator disposed on a deformable support structure, the support structure defining a pumping chamber of a printhead; responsive to application of the voltage, deforming the piezoelectric actuator along a trench defined in a top surface of the piezoelectric actuator; and ejecting a drop of fluid from the pumping chamber by deformation of a deformable portion of the support structure caused by the deformation of the piezoelectric actuator.

Embodiments can include one or more of the following features.

Applying the voltage comprises applying the voltage to deform the actuator such that a volume of the pumping chamber is increased.

In a general aspect, a method includes disposing a piezoelectric actuator on a support structure of a printhead, the support structure defining a pumping chamber of the printhead; and forming a trench in a top surface of the actuator.

Embodiments can include one or more of the following features.

Forming the trench comprises forming the trench such that the trench is offset inwardly from a perimeter of the deformable portion.

Forming the trench comprises forming the trench such that the trench defines a curve having a first end and a second end, the curve offset inwardly from a portion of a perimeter of the deformable portion.

Forming the trench comprises forming the trench such that the trench defines at least a portion of a loop offset inwardly from a portion of a perimeter of the deformable portion.

The trench is a first trench, and the method further comprises forming a second trench in the top surface of the actuator, the second trench extending radially outward from the first trench.

The method includes forming a third trench defining a rounded perimeter on the exterior surface, and forming the second trench comprises forming the second trench such that the second trench extends from a first end connected to the first trench to a second end connected to the third trench.

Forming the trench comprises forming the trench such that the trench extends radially outwardly away from a central region of the top surface of the actuator.

The method includes forming multiple radial trenches each extending radially outward away from a central region of the top surface of the actuator.

Forming the radial trenches comprises forming the multiple trenches such that a path of each of the radial trenches is perpendicular to the trench.

Forming the trench comprises forming the trench such that a distance between the trench and a perimeter of the deformable portion is less than a distance between the trench and a central region of the top surface of the actuator.

Forming the trench comprises forming the trench through the thickness of the actuator from the top surface of the actuator to exterior top surface of the deformable portion of the support structure.

Forming the trench comprises forming the trench such that a width of the trench is between 0.1 micrometers and 10 micrometers.

Forming the trench comprises forming the trench such that a distance between the trench and a perimeter of the deformable portion is greater than a distance between the trench and a central region of the top surface of the actuator.

Forming the trench comprises forming the trench such that a distance between the trench and a perimeter of the deformable portion is 20% and 80% of the distance between a central region of the top surface of the actuator and the perimeter of the deformable portion.

Forming the trench comprises forming the trench such that the trench overlaps with a perimeter of the deformable portion.

Forming the trench comprises etching the exterior surface of the actuator to form the trench.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

A fluid delivery system, e.g., for an ink jet printer, can have a high-output actuator that is capable of ejecting large drops of fluid, such as drops with a volume of 0.1 picoliters to 100 picoliters. A high-output actuator can also enable the size of a fluid ejector to be reduced while maintaining the ability to eject a given drop size from the fluid delivery system. Smaller fluid ejectors generally cost less to produce, e.g., because they occupy less space on the material stock from which the fluid ejectors are formed. Furthermore, smaller fluid ejectors can have a higher resonant period and hence can achieve faster jetting. The fluid delivery systems with high-output actuators described herein utilize actuators including one or more trenches formed therein to facilitate increased fluid delivery output from fluid ejectors.

Figure 1:
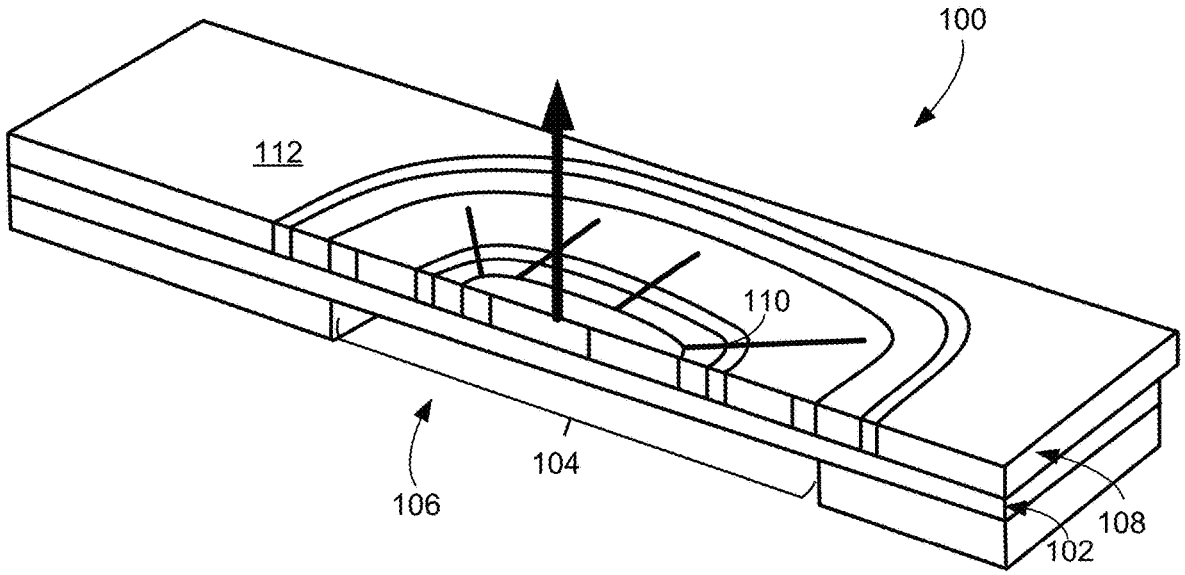
FIG. 1 is a cross-sectional perspective view of an actuator.
Figure 2:
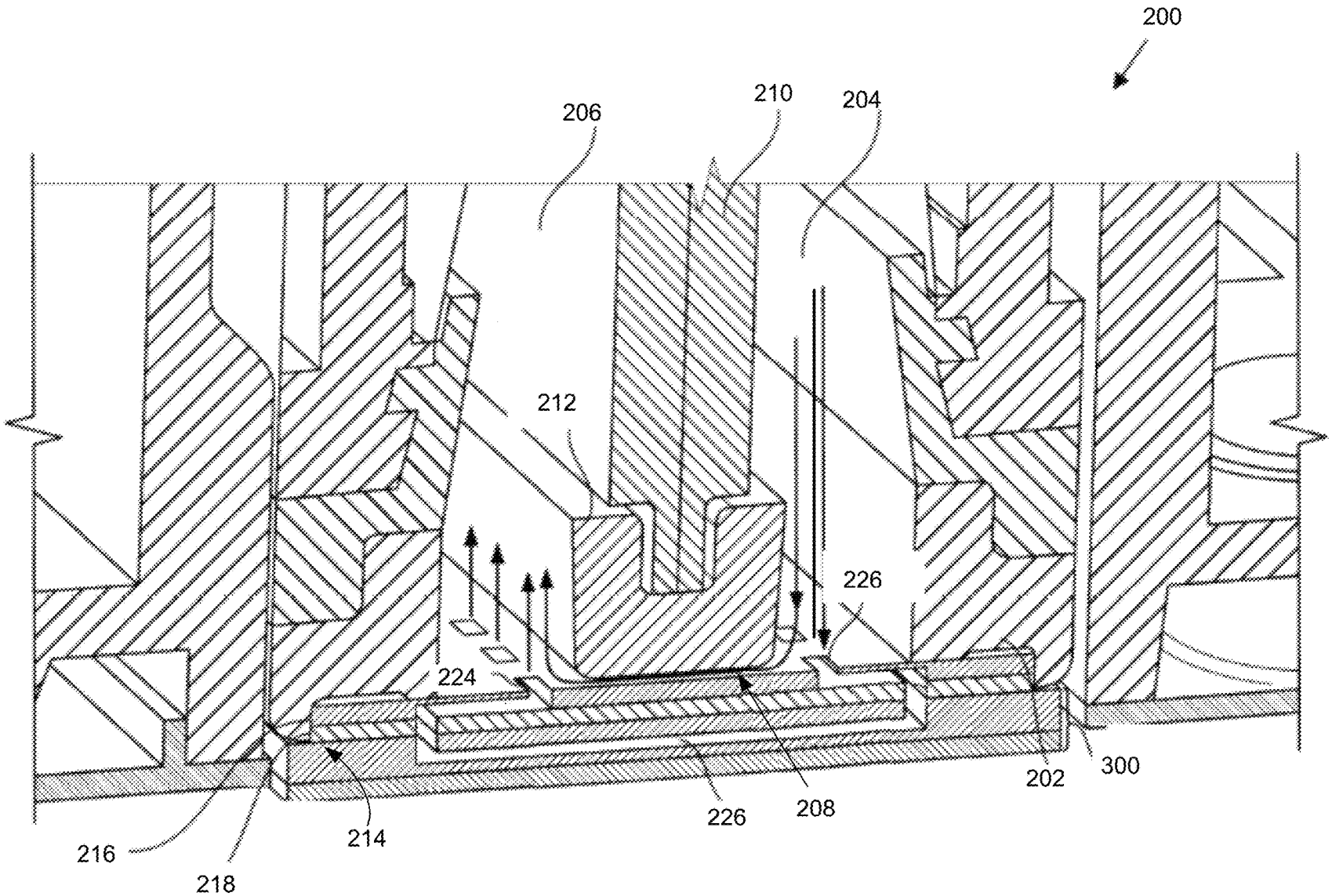
FIG. 2 is a cross-sectional view of a printhead

FIG. 1 depicts an example of a fluid delivery system 100, e.g., for a printhead 200 shown in FIG. 2, capable of high fluid delivery output. In particular, FIG. 1 shows a cross-sectional perspective view of the fluid delivery system 100, which includes a support structure 102 of the printhead 200 and an actuator 108. A deformable portion 104 of the support structure 102, such as a deformable membrane, defines a pumping chamber 106. The actuator 108 is positioned on the deformable portion 104 of the support structure 102. The actuator 108 causes the deformable portion 104 of the support structure 102 to deform, thus causing a drop of fluid to be ejected from the pumping chamber 106.

The actuator 108 includes a trench arrangement including one or more trenches formed in the actuator 108, such as on an exterior surface 112 of the actuator 108. The actuator 108 can be positioned such that the actuator 108 is fixed in a region outside of the deformable portion 104 of the support structure 102. In this regard, when the actuator 108 is actuated, the actuator 108 deforms in a region of the deformable portion 104 but experiences substantially no deformation in the region outside of the deformable portion 104. The trench 110 can facilitate higher deformation of the deformable portion 104 when the actuator 108 is driven by a given voltage.

In some implementations, the fluid delivery system 100 forms a part of a printhead 200 as depicted in FIG. 2. The printhead 200 ejects droplets of fluid, such as ink, biological liquids, polymers, liquids for forming electronic components, or other types of fluid, onto a surface. The printhead 200 includes one or more fluid delivery systems 100, each fluid delivery system including a corresponding support structure 102 and actuator 108, as described with respect to FIG. 1.

Figure 3:
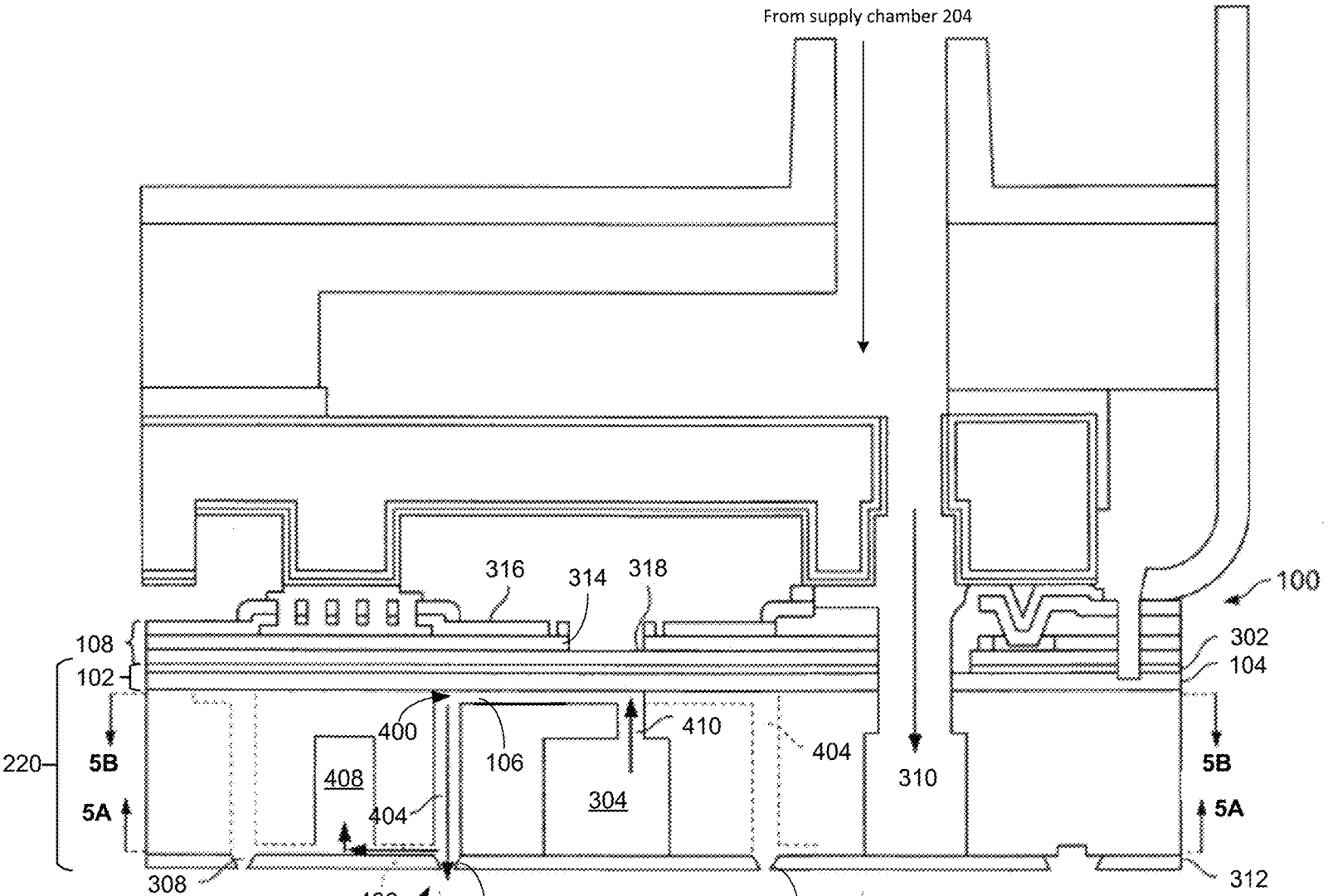
FIG. 3 is a cross sectional view of a portion of a printhead.
Figure 4:
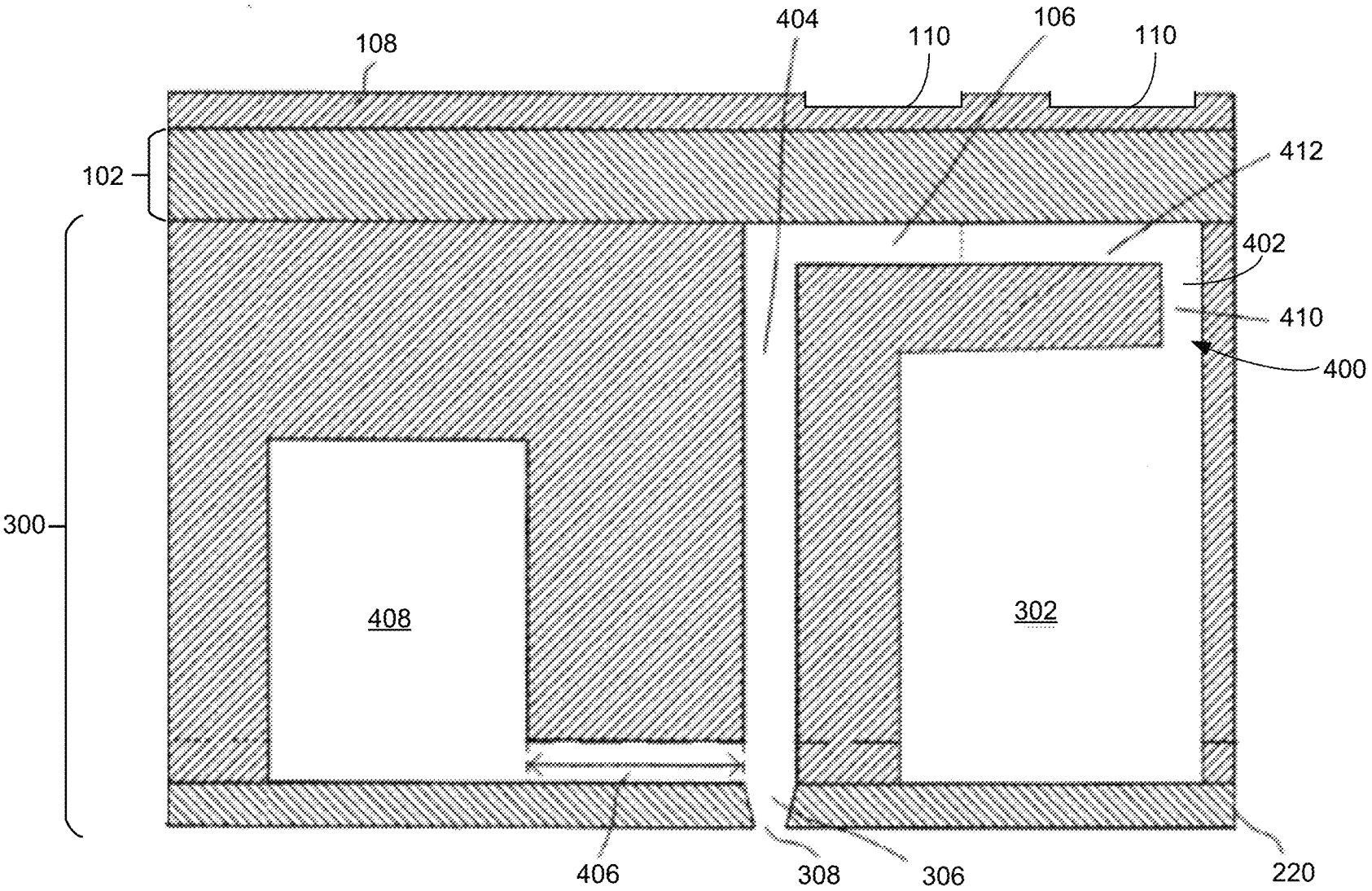
FIG. 4 is a cross sectional view of a fluid ejector.

Referring to FIGS. 2-4, the printhead 200 includes a substrate 300 coupled to the support structures 102 of the fluid delivery systems 100 and to an interposer assembly 214. The substrate 300 is, in some cases, a monolithic semiconductor body, such as a silicon substrate, with passages formed therethrough that define flow paths for fluid through the substrate 300. In some implementations, the substrate 300 and the support structure 102 of a particular fluid delivery system 100 together define the pumping chamber 106 of that fluid delivery system. In some implementations, the support structure 102 is part of the substrate 300.

The printhead 200 includes a casing 202 having an interior volume divided into a fluid supply chamber 204 and a fluid return chamber 206. In some cases, the interior volume is divided by a dividing structure 208. The dividing structure 208 includes, for example, an upper divider 210 and a lower divider 212. The bottom of the fluid supply chamber 204 and the fluid return chamber 206 is defined by the top surface of the interposer assembly 214.

The interposer assembly 214 is attachable to the casing 202, such as by bonding, friction, or another mechanism of attachment. The interposer assembly 214 includes, for example, an upper interposer 216 and a lower interposer 218. The lower interposer 218 is positioned between the upper interposer 216 and the substrate 300. The upper interposer 216 includes a fluid supply inlet 222 and a fluid return outlet 224. The fluid supply inlet 222 and fluid return outlet 224, for example, are formed as apertures in the upper interposer 216.

A flow path 226 is formed to connect the fluid supply chamber 204 to the fluid return chamber 206. The flow path 226 is, for example, formed in the upper interposer 216, the lower interposer 218, and the substrate 300. The flow path 226 enables flow of fluid from the supply chamber 204, through the substrate 300, into the fluid supply inlet 222, and, as shown in FIG. 3, to one or more fluid ejectors 306 for ejection of fluid from the printhead 200. In some implementations, the fluid delivery system 100 includes one or more of the fluid ejectors 306 such that the actuator 108 of the fluid delivery system 100, when driven, ejects fluid from the pumping chamber 106 through the fluid ejectors 306. The flow path 226 also enables flow of fluid from the fluid ejectors 306, into the fluid return outlet 224, and into the return chamber 206. While FIG. 2 depicts the flow path 226 as a single flow path forming a straight passage, in some implementations, the printhead 200 includes multiple flow paths. Alternatively or additionally, one or more of the flows path are not straight.

In the flow path 226, a substrate inlet 310 receives fluid from the supply chamber 204, extends through the substrate 300, in particular, through the support structure 102, and supplies fluid to one or more inlet feed channels 304. Each inlet feed channel 304 supplies fluid to multiple fluid ejectors 306 through a corresponding inlet passage.

Each fluid ejector 306 includes one or more nozzles 308, such as a single nozzle. The nozzles 308 are formed in a nozzle layer 312 of the substrate 300, e.g., on a bottom surface of the substrate 300. In some examples, the nozzle layer 312 is an integral part of the substrate 300. In some examples, the nozzle layer 312 is a layer that is deposited onto the surface of the substrate 300. Fluid is selectively ejected from the nozzle 308 of one or more of the fluid ejectors 306. The fluid is, for example, ink that is ejected onto a surface to print an image on the surface.

Fluid flows through each fluid ejector 306 along an ejector flow path 400. The ejector flow path 400 includes, for example, a pumping chamber inlet passage 402, a pumping chamber 106, a descender 404, and an outlet passage 406. The pumping chamber inlet passage 402 connects, e.g., fluidically connects, the pumping chamber 106 to the inlet feed channel 304. The pumping chamber inlet passage 402 includes, in some examples, an ascender 410 and a pumping chamber inlet 412. The descender 404 is connected to a corresponding nozzle 308. The outlet passage 406 connects the descender 404 to an outlet feed channel 408. In some examples, a substrate outlet (not shown) connects the outlet feed channel 408 to the return chamber 206.

In the example shown in FIGS. 3 and 4, passages such as the substrate inlet 310, the inlet feed channel 304, and the outlet feed channel 408 are in a common plane. In some examples, one or more of the substrate inlet 310, the inlet feed channel 304, and the outlet feed channel 408 are not in a common plane with the other passages.

Figure 5A:
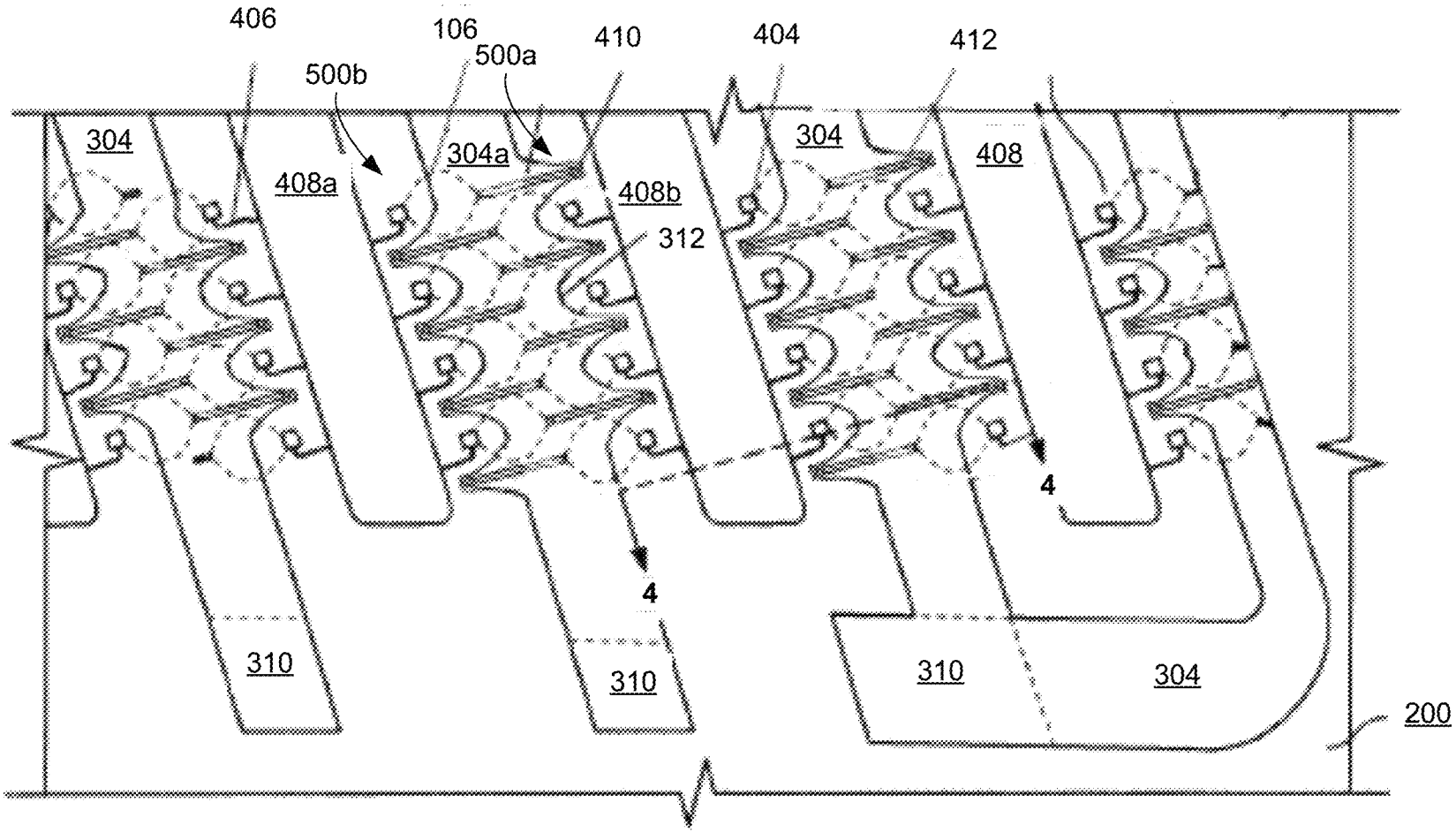
FIG. 5A is a cross sectional view of a portion of the printhead taken along line 5A-5A in FIG. 3.
Figure 5B:
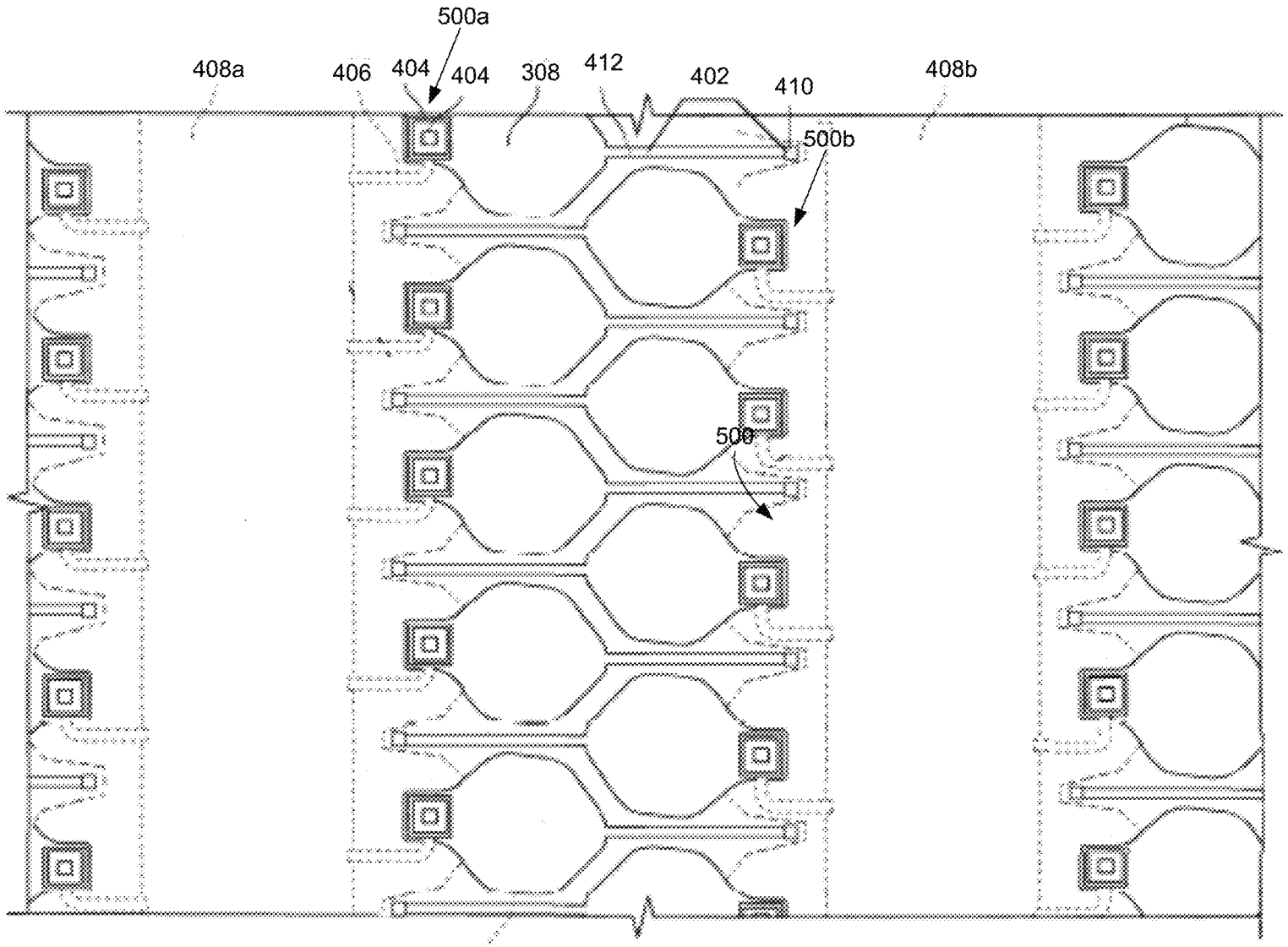
FIG. 5B is a cross sectional view of a portion of the printhead taken along line 5B-5B in FIG. 3.

Referring to FIGS. 5A and 5B, the substrate 300 includes multiple inlet feed channels 304 formed therein and extending parallel with one another. Each inlet feed channel 304 is in fluidic communication with at least one substrate inlet 310 that extends from the inlet feed channels 304, e.g., extends perpendicularly from the inlet feed channels 304. Multiple outlet feed channel 408 are formed in the substrate 300 and, in some cases, extend parallel with one another. Each outlet feed channel 408 is in fluidic communication with at least one substrate outlet (not shown) that extends from the outlet feed channel 408, e.g., extends perpendicularly from the outlet feed channel 408. In some examples, the inlet feed channels 304 and the outlet feed channel 408 are arranged in alternating rows.

The substrate includes multiple fluid ejectors 306. Fluid flows through each fluid ejector 306 along a corresponding ejector flow path 400, which includes an ascender 410, a pumping chamber inlet 412, a pumping chamber 106, and a descender 404. Each ascender 410 is connected to one of the inlet feed channels 304. Each ascender 410 is also connected to the corresponding pumping chamber 106 through the pumping chamber inlet 412. The pumping chamber 106 is connected to the corresponding descender 404, which is connected to the associated nozzle 308. Each descender 404 is also connected to one of the outlet feed channel 408 through the corresponding outlet passage 406. For instance, the cross-sectional view of the fluid ejector 306 of FIG. 4 is taken along line 4-4 of FIG. 5A.

The particular flow path configuration may vary in some implementations. In some examples, the printhead 200 includes multiple nozzles 308 arranged in parallel columns 500. The nozzles 308 in a given column 500 can be all connected to the same inlet feed channel 304 and the same outlet feed channel 408. That is, for instance, all of the ascenders 410 in a given column can be connected to the same inlet feed channel 304 and all of the descenders in a given column can be connected to the same outlet feed channel 408.

In some examples, nozzles 308 in adjacent columns can all be connected to the same inlet feed channel 304 or the same outlet feed channel 408, but not both. In another example, each nozzle 308 in column 500*a* is connected to the inlet feed channel 304*a* and to the outlet feed channel 408*a*. The nozzles 308 in the adjacent column 500*b* are also connected to the inlet feed channel 304*a* but are connected to the outlet feed channel 408*b*.

In some examples, columns of nozzles 308 can be connected to the same inlet feed channel 304 or the same outlet feed channel 408 in an alternating pattern. Further details about the printhead 200 can be found in U.S. Pat. No. 7,566,118, the contents of which are incorporated herein by reference in their entirety.

Referring again to FIG. 3, each fluid ejector 306 has a corresponding actuator 108, such as a piezoelectric actuator, a resistive heater, or another type of actuator. The pumping chamber 106 of each fluid ejector 306 is in close proximity to the corresponding actuator 108. Each actuator 108 is configured to be selectively actuated to pressurize the corresponding pumping chamber 106, e.g., by deforming in a manner to pressurize the pumping chamber 106. When the pumping chamber 106 is pressurized, fluid is ejected from the nozzle 308 connected to the pressurized pumping chamber.

Figure 6A:
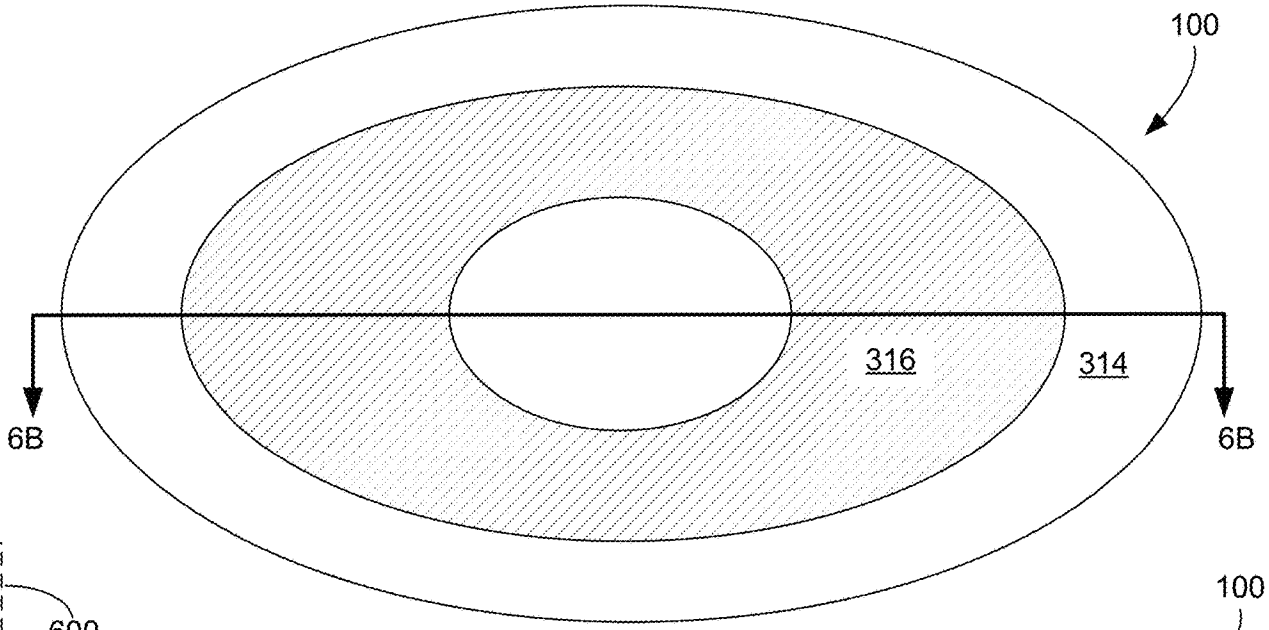
FIG. 6A is a top view of a fluid delivery system.
Figure 6B:
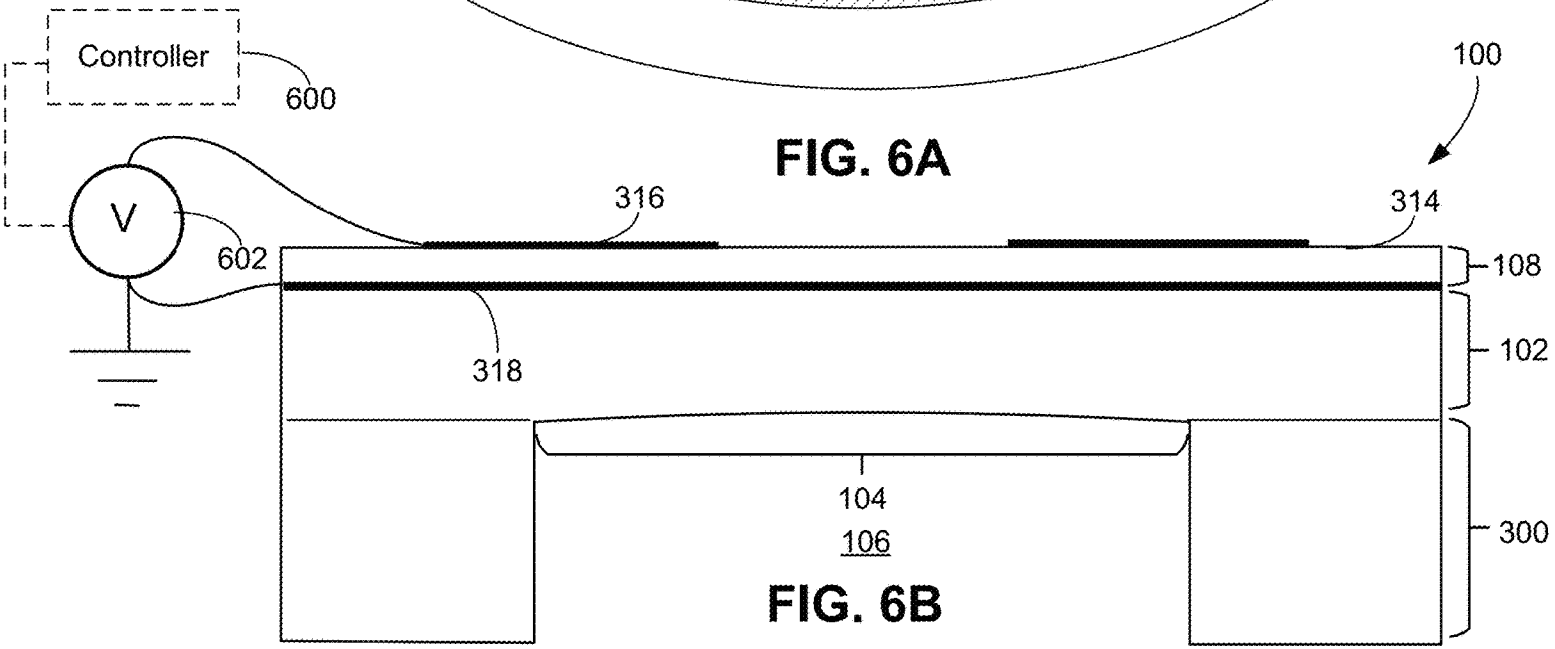
FIG. 6B is a schematic side view of the fluid delivery system of FIG. 6A.

Referring to FIGS. 6A and 6B, the actuator 108 includes, for example, a piezoelectric layer 314, such as a layer of lead zirconium titanate (PZT). The piezoelectric layer 314 can have a thickness of about 50 μm or less, e.g., about 1 μm to about 25 μm, e.g., about 2 μm to about 5 μm. In the example of FIG. 3, the piezoelectric layer 314 is continuous. In some examples, the piezoelectric layer 314 is discontinuous. The piezoelectric layer 314, if discontinuous, includes two or more disconnected portions that are formed by, for example, an etching or sawing step during fabrication.

In some implementations, the actuator 108 includes first and second electrodes. The piezoelectric layer 314 is positioned between the first and second electrodes. The first electrode is, for example, a drive electrode 316, and the second electrode is, for example, a ground electrode 318.

The drive electrode 316 and the ground electrode 318 are, for example, formed from a conductive material (e.g., a metal), such as copper, gold, tungsten, indium-tin-oxide (ITO), titanium, platinum, or a combination of conductive materials. The thickness of the drive electrode 316 and the ground electrode 318 is, e.g., about 3 μm or less, about 2 μm or less, about 0.23 μm, about 0.12 μm, about 0.5 μm. In some implementations, the drive electrode 316 and the ground electrode 318 are different sizes. The ground electrode 318 has a thickness, for example, that is 100% to 300% of the thickness of drive electrode 316. In one example, the ground electrode 318 has a thickness of 0.23 μm, and the drive electrode 316 has a thickness of 0.12 μm.

The support structure 102 is positioned between the actuator 108 and the pumping chamber 106, thereby isolating the ground electrode 318 from fluid in the pumping chamber 106. In some examples, the support structure 102 is a layer separate from the substrate 300. In some examples, the support structure 102 is unitary with the substrate 300. While FIGS. 6A and 6B depict the ground electrode 318 positioned between the support structure 102 and the piezoelectric layer 314, in some implementations, the drive electrode 316 is positioned between the support structure 102 and the piezoelectric layer 314.

To actuate the piezoelectric actuator 108, an electrical voltage can be applied between the drive electrode 316 and the ground electrode 318 to apply a voltage to the piezoelectric layer 314. The applied voltage induces a polarity on the piezoelectric actuator that causes the piezoelectric layer 314 to deflect, which in turn deforms the support structure 102, e.g., deforms the deformable portion 104 of the support structure 102. The deflection of the deformable portion 104 of the support structure 102 causes a change in volume of the pumping chamber 106, producing a pressure pulse in the pumping chamber 106. The pressure pulse propagates through the descender 404 to the corresponding nozzle 308, thus causing a droplet of fluid to be ejected from the nozzle 308.

The printhead 200, in some implementations, includes a controller 600 to apply a voltage to the drive electrode 316 to deform the deformable portion 104 of the support structure 102. The controller 600, for example, operates a drive 602, e.g., a controllable voltage source to modulate a voltage applied to the drive electrode 316. The applied voltage causes the deformable portion 104 of the support structure 102 to deform by a selectable amount. In some implementations, the voltage is applied to the drive electrode 316 in a manner such that the deformable portion 104 of the support structure 102 deforms away from the pumping chamber 106. The voltage applied, for example, results in a voltage differential, e.g., a polarity, between the ground electrode 318 and the drive electrode 316 that deflects the piezoelectric layer 314 toward the drive electrode 316. In this regard, if the ground electrode 318 is positioned between the deformable portion 104 and the piezoelectric layer 314, the deformable portion 104 deforms away from the pumping chamber 106.

In some implementations, the support structure 102 is formed of a single layer of silicon, e.g., single crystalline silicon. In some implementations, the support structure 102 is formed of another semiconductor material, one or more layers of oxide, such as aluminum oxide (AlO2) or zirconium oxide (ZrO2), glass, aluminum nitride, silicon carbide, other ceramics or metals, silicon-on-insulator, or other materials. The support structure 102 is, for example, formed of an inert material having a compliance such that the deformable portion 104 of the support structure 102 flexes sufficiently to eject a drop of fluid when the actuator 108 is driven. In some examples, the support structure 102 is secured to the actuator 108 with an adhesive portion 302. In some examples, two or more of the substrate 300, the nozzle layer 312, and the deformable portion 104 are formed as a unitary body.

In some implementations, the actuator includes a trench arrangement including one or more trenches formed in the exterior surface of the actuator. The trenches can take on a variety of shapes, such as those shown in FIGS. 7-9. The examples of trenches described herein can enable a greater amount of fluid to be ejected from a pumping chamber during operation of an actuator without resulting in greater hoop stresses on the actuator. FIG. 10 depicts an example of operation of an actuator 1002 of a fluid delivery system 1000. When driven, the actuator 1002 deflects in a manner to eject fluid from a pumping chamber 1004 through a nozzle (not shown). When the actuator 1002 is deformed, the pumping chamber 1004 expands to eject fluid. In some cases, as described herein, a trench formed on the actuator 1002 reduces the amount of hoop stress in the actuator 1002 given an amount of volumetric expansion of the pumping chamber 1004 to eject the fluid.

As shown in the inset 1006 of FIG. 10, a trench 1008 is formed within a perimeter 1010 of the deformable portion 104 of the support structure 102. In some implementations, the trench 1008 extends from an exterior surface 1014 of the actuator 1002 to an exterior surface 1016 of the deformable portion 104. In some implementations, the deformable portion 104 includes an oxide layer 1018, and the exterior surface 1016 of the deformable portion 104 is an exterior surface of the oxide layer 1018.

During the operation of the actuator 1002 in which the actuator 1002 is driven to deform the deformable portion 104, the trench 1008, by extending circumferentially, serves as a hinge. In particular, the position of the trench 1008 determines the location of the inflection point for the curvature of the actuator 1002 when the actuator 1002 is deflected. The inflection point corresponds to a point at which the curvature of the actuator 1002 changes sign, e.g., the point at which the actuator 1002 goes from curving inward to curving outward or curving outward to curving inward. The trench 1008 is, in this regard, is positioned near the perimeter 1010 or near the center 1020 of the deformable portion 104. By being positioned in this manner, a greater portion of the actuator 1002 is curved in the same direction, e.g., curved inward or curved outward. As a result, the actuator 1002 can achieve a greater magnitude of deformation, thereby resulting in greater achievable volumetric expansion of the pumping chamber 1004. If the trench 1008 is positioned near the perimeter 1010, the deformation of the deformable portion 104 in the region between the trench 1008 and the center 1020 is greater than the deformation of a deformable portion without a trench. If the trench 1008 is positioned near the center 1020, the deformation of the deformable portion 104 in the region between the perimeter 1010 and the trench 1008 is greater than the deformation of a deformable portion without a trench. The trench 1008 can therefore increase an amount of fluid that can be ejected from the pumping chamber 1004 when the actuator 1002 is driven. In particular, each drop of fluid ejected from the pumping chamber 1004 has a volume between 0.01 mL and mL 80.

As described herein, the actuator 1002 is a piezoelectric actuator that deforms in response to a voltage differential, e.g., a polarity maintained between its electrodes 1022, 1024. As shown in FIG. 10, to operate the actuator 1002, a first voltage $V_1$ is applied to the electrode 1022 of the actuator 1002. A second voltage $V_2$ is applied to the electrode 1024 of the actuator 1002 to maintain a polarity between the electrodes 1022, 1024. The controller 1025, for example, operates a drive 1027 to apply the first voltage $V_1$, and the controller 1025 operates the drive 1027 to apply the second voltage $V_2$. The polarity deforms the actuator 1002 along the trench 1008 such that the pumping chamber 1004 defined by the support structure 102 ejects a drop of fluid, e.g., through a fluid ejector 306.

In some cases, the first voltage $V_1$ is a ground voltage, and the second voltage $V_2$ is the voltage applied by a voltage source, e.g., the drive 1027. In this regard, the electrode 1022 corresponds to a ground electrode, and the electrode 1024 corresponds to a ground electrode.

In some implementations, the second voltage $V_2$, when applied, deforms the actuator 1002 in a manner that increases a volume of the pumping chamber 1004. When the second voltage $V_2$ is reduced, the volume of the pumping chamber 1004 decreases, thereby causing the drop of fluid to be ejected.

Figure 7:
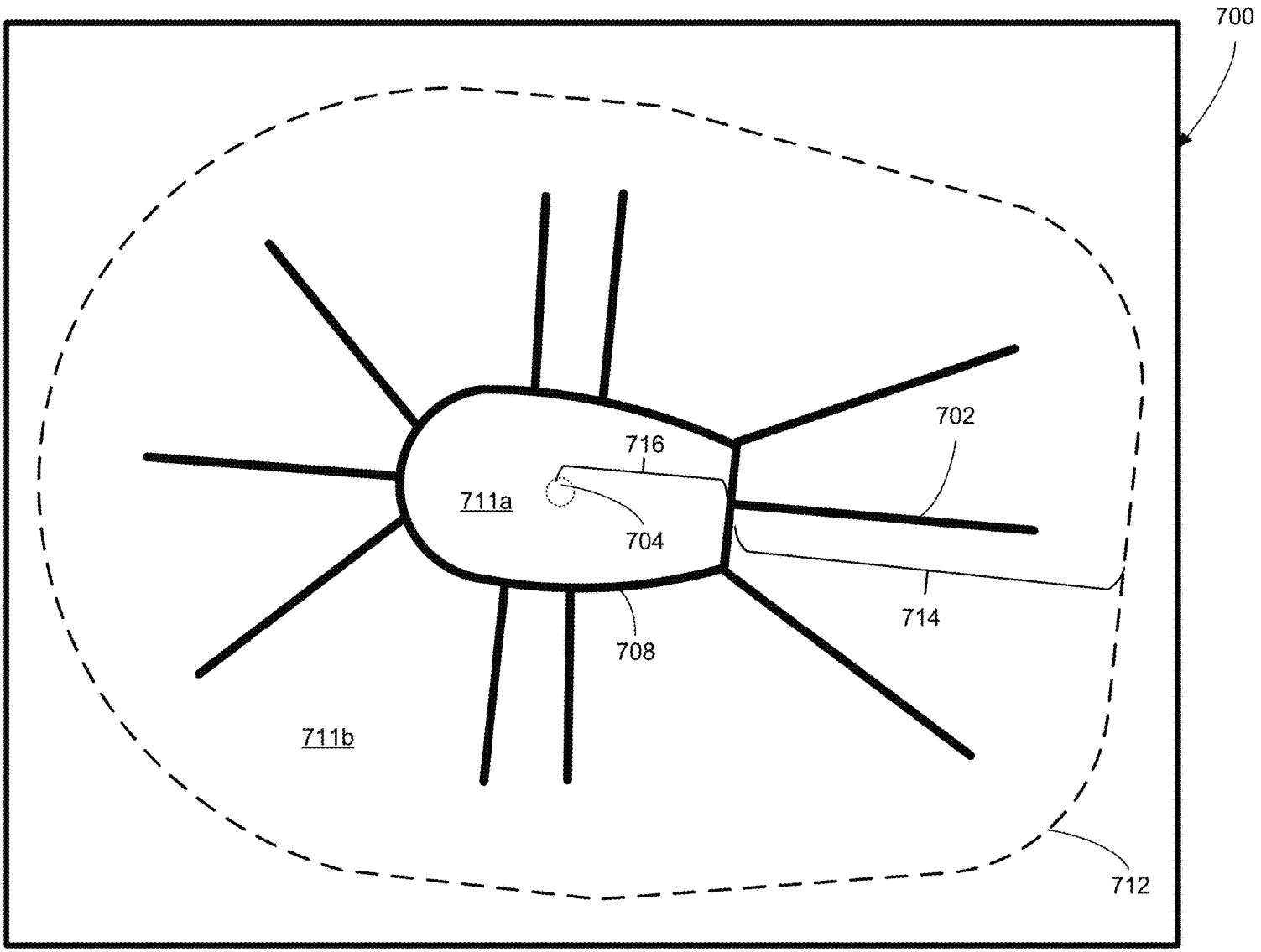
FIG. 7 is a top view of an example of an actuator.

While FIG. 10 depicts the trench 1008 as a circumferentially extending trench, in some implementations, in addition to including the trench 1008, the actuator 1002 includes radially extending trenches, round trenches, or other trenches as described herein. As described herein, various arrangements of trenches are possible to increase an amount of deflection of the actuator when driven by a given voltage and to reduce the hoop stress caused by a given amount of deflection of the actuator. Referring to FIG. 7, in an example, an actuator 700 includes a trench arrangement including a trench 702. The trench 702 is a radially extending trench, e.g., a trench extending radially outwardly away from a center 704 of a deformable portion of a support structure, etc. As described herein, the radially extending trench 702 can reduce hoop stresses through the actuator 700 through which the trench 702 extends.

In some implementations, the trench arrangement includes multiple radially extending trenches. The trench 702 is, for instance, one of multiple radially extending trenches 702. The radially extending trenches 702 are, for example, angled relative to one another. Each of the radially extending trenches 702, for example, extend radially outwardly away from the center 704. The center 704 corresponds to, for example, a geometric centroid of the deformable portion 104.

In implementations in which the trench arrangement includes multiple trenches, the distribution of the trenches 702 through the actuator 700, in some examples, depends on a curvature of a perimeter 712 of the deformable portion. Each of the trenches 702 extends along a corresponding axis that passes through the perimeter 712. The corresponding axis, for example, extends from the center 704 of the deformable portion and through the perimeter 712. In some implementations, if the perimeter 712 includes a lower curvature portion and a higher curvature portion, the actuator 700 has a different number of trenches per unit length in the higher curvature portion than the number of trenches per unit length in the lower curvature portion. In particular, the per unit length number of trenches in the higher curvature portion can be greater than the per unit length number of trenches in the lower curvature portion. The highest curvature portions of the perimeter 712 can correspond to the portions of the deformable portion that have the highest hoop stresses. The greater number of trenches 702 proximate the higher curvature portions can thus to reduce the higher hoop stresses near those portions.

In some implementations, the trench arrangement of the actuator 700 includes a trench 708, such as a circumferential trench. The trench 708 is, for example, offset inwardly (e.g., toward the center 704 of the deformable portion) from the perimeter 712. The trench 708 defines a loop offset inwardly from a portion of the perimeter 712. In some examples, the shape of the loop defined by the trench 708 can track the perimeter 712 of the deformable portion. In some implementations, a center of the trench 708 is coincident with the center 704 of the deformable portion, e.g., a geometric centroid of an area circumscribed by the trench 708 is coincident with the geometric centroid of the deformable portion. The trench 708 is positioned such that a deformation of the actuator 700 along a radius extending from the center 704 is greater from the perimeter 712 to the trench 708 than deformation expected in actuators without such a trench.

The loop defined by the trench 708 can be a continuous loop that surrounds the center 704 of the actuator 700. In this regard, the trench 708 divides the actuator 700 into a central inner portion 711*a* and an outer portion 711*b* surrounding the central interior portion 711*b*. The trenches 702 extend radially through \the outer portion 711*b*. The central inner portion 711*a* is discontinuous relative to the outer portion 711*b* and is separated from the outer portion 711*b* by the trench 708.

In some cases, a distance 714 between the trench 708 and the perimeter 712 of the deformable portion is greater than a distance 716 between the trench 708 and the center 704 of the deformable portion. In some cases, the distance 714 between the trench and the perimeter 712 is 20% and 80% of the distance 716 between the trench 708 and the center 704.

In some implementations, an electrode, e.g., the drive electrode 316, of the actuator 700 is positioned on the exterior surface of actuator 700 and between the trench 708 and the perimeter 712 of the deformable portion. In this regard, the electrode of the actuator 700 is a ring having an inner perimeter and an outer perimeter. The thickness of the ring electrode (e.g., the distance between the inner perimeter and the outer perimeter) can be equal to or less than the distance 714 between the trench 708 and the perimeter 712 of the deformable portion. The trench arrangement of the actuator 700 can enable the electrode of the actuator 700 to be positioned closer to the center 704 of the deformable portion than in cases in which the actuator 700 does not have the trench arrangement.

As depicted in FIG. 7, in some implementations, the trench arrangement of the actuator 700 includes both the trench 702 and the trench 708. The trench 702 is, for example, perpendicular to the trench 708 at the point where the trench 702 meets the trench 708. If the actuator 700 includes multiple trenches 702, each of the multiple trenches 702 is perpendicular to the trench 708 at the point where the trench 702 meets the trench 708. In some implementations, the actuator 700 includes only one or more radially extending trenches 702 without the circumferential trench 708. In some examples, the actuator 700 includes only the circumferential trench 708 without the radially extending trenches 702.

Figure 8:
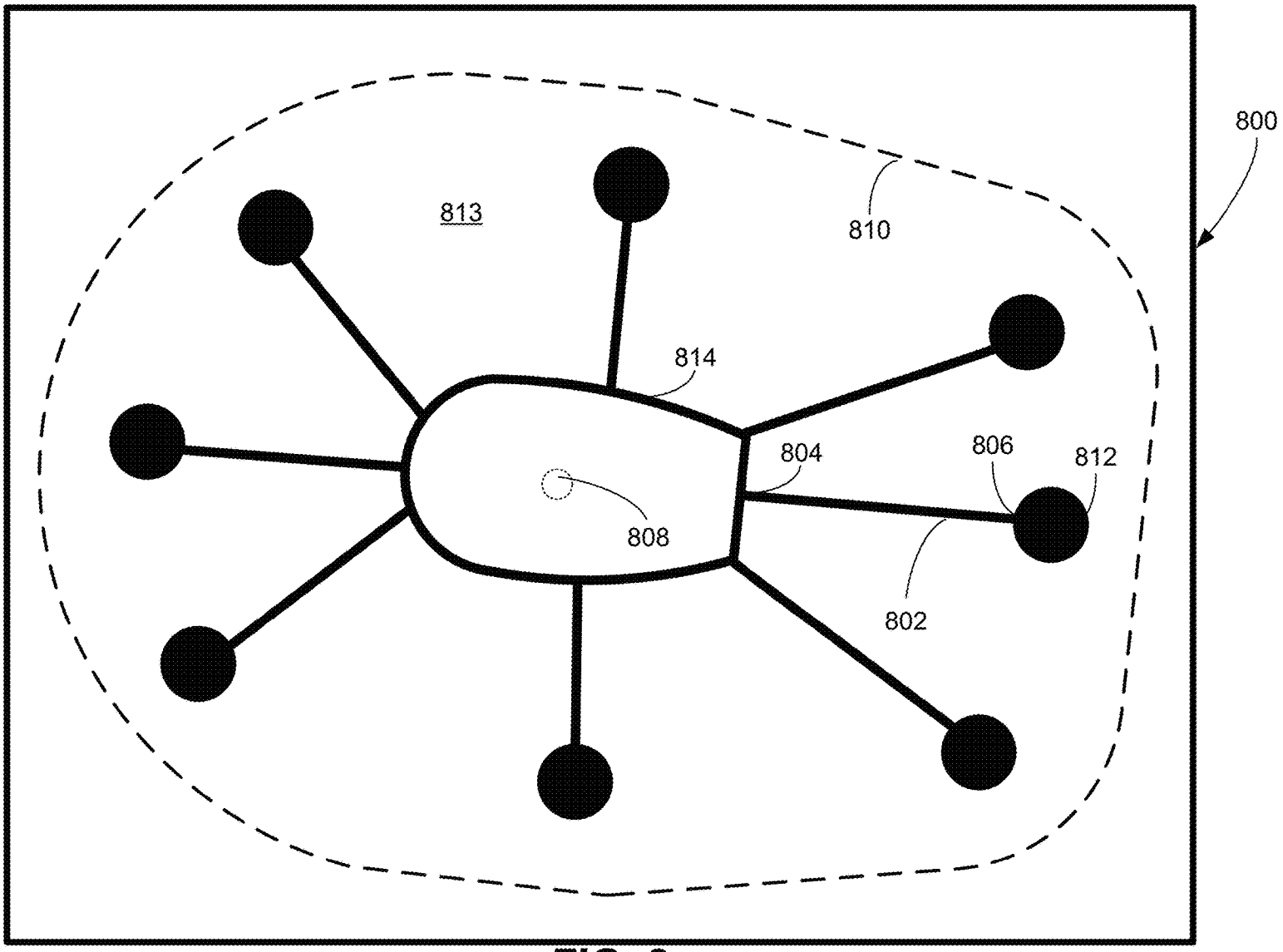
FIG. 8 is a top view of an example of an actuator.

Similar to the actuator 700 of FIG. 7, the example of the actuator 800 shown in FIG. 8 includes a trench arrangement including one or more radially extending trenches 802. Each of the radially extending trenches 802 includes a first end 804 and a second end 806. The first end 804 is, for example, proximate a center 808 of the deformable portion defined by a perimeter 810. The second end 806 is, for example, proximate the perimeter of the deformable portion. The trench arrangement of the actuator 700 includes a trench 812 having a rounded perimeter on the exterior surface 813 of the actuator 800. The trenches 802 extend radially along a length toward the perimeter 810, and the trench 812 has, for example, a width greater than a width of the trenches 802. The width of the trench 812 is greater than, for example, a width of the trench 802 to which the trench 812 is connected. The trench 812 has, for example, a circular or an elliptical perimeter on the exterior surface 813 of the actuator 800. If the trench 812 has a circular or elliptical perimeter, in some cases, the perimeter has a diameter greater than the width of the trenches 802.

The trench 812 at the second end 806 of the trench 802 can reduce the stress experienced by the actuator 800 proximate the second end 806 of the trench 802. For example, the rounded geometry of the trench 812 can reduce a magnitude of stress concentrations at the second end 806 of the trench 802 when the actuator 800 is deformed.

In some implementations, the trench 812 is one of multiple trenches 812, e.g., the trench arrangement includes multiple trenches 812. Each of the trenches 812 is positioned at the second end of a corresponding radially extending trench 802. In some examples, the actuator 800 includes a trench 814 similar to the trench 708 described with respect to FIG. 7. In this regard, the trench arrangement of the actuator 800 includes three interconnected trenches, e.g., the trenches 802, the trenches 812, and the trench 814.

In some implementations, the width of the trenches 802, 814 is between 0.1 and 10 micrometers, e.g., between 0.1 and 1 micrometers, and 1 and 10 micrometers. In some implementations, the width of the trenches 812 is between 0.1 and 100 micrometers, e.g., between 0.1 and 1 micrometers, 1 and 10 micrometers, and 10 and 100 micrometers.

Figure 9:
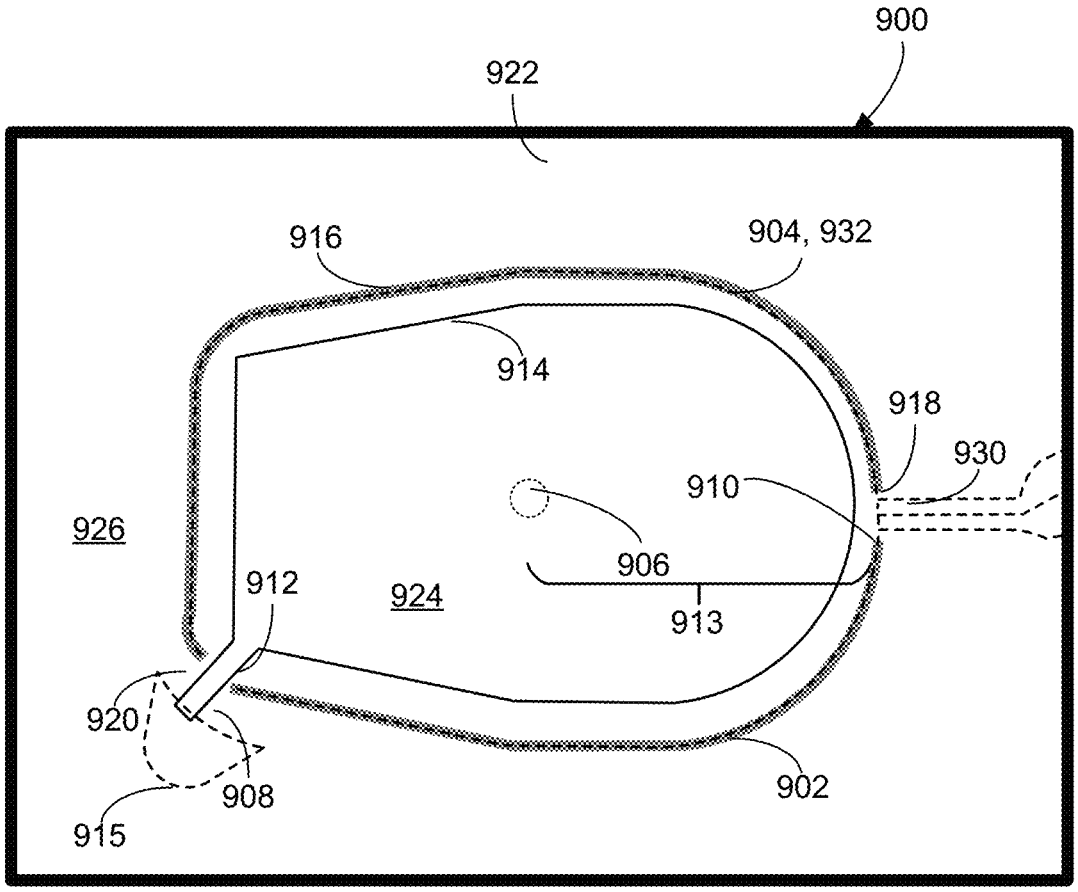
FIG. 9 is a top view of an example of an actuator.
Figure 10:
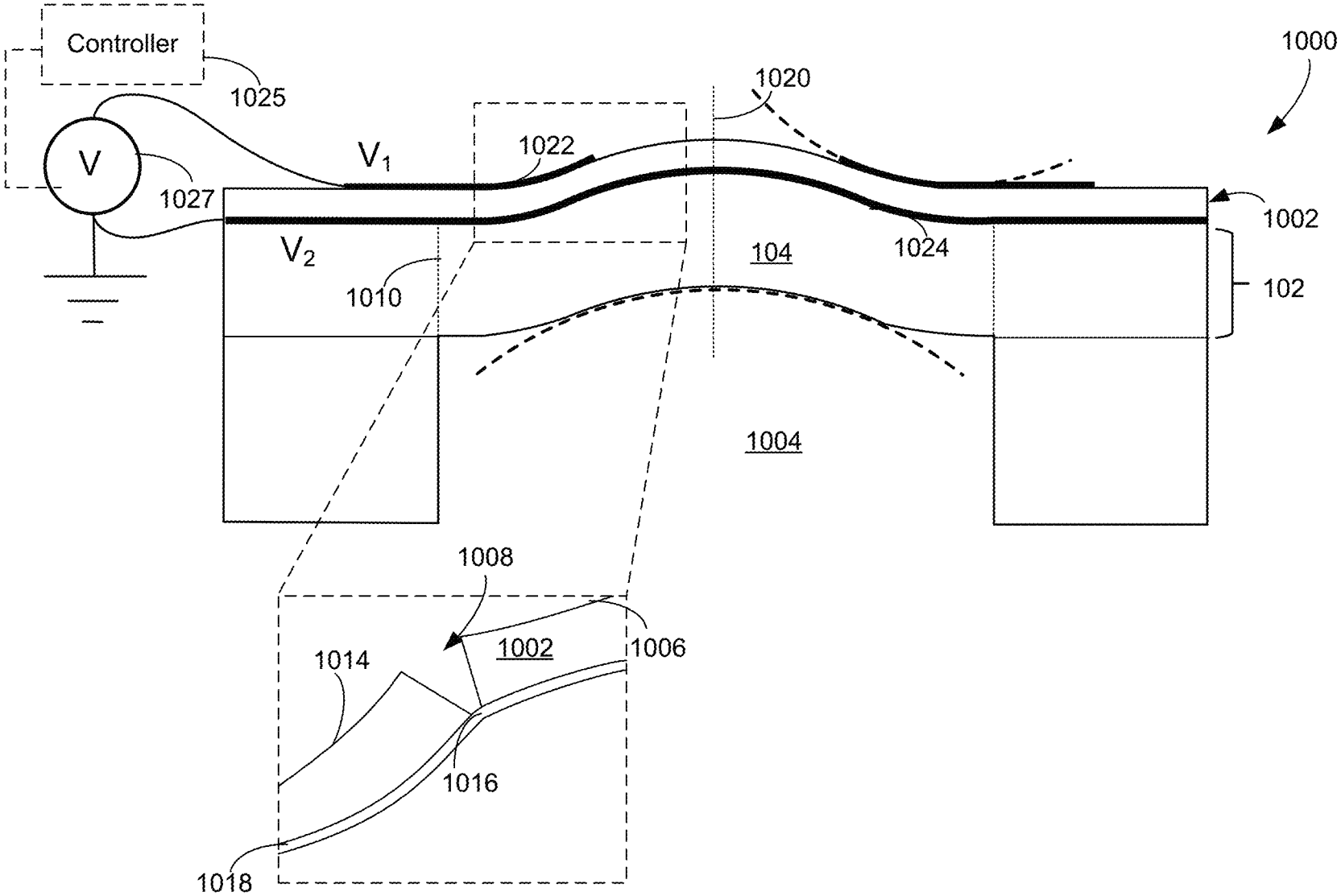
FIG. 10 is a side schematic view of a fluid delivery system in which is an actuator of the fluid delivery system is deformed.

While the examples of the actuators 700, 800 includes trenches 708, 814, respectively, that are closer to the center of the deformable portion than to the perimeter of the deformable portion, in some implementations, as shown in FIG. 9, an actuator 900 includes a trench arrangement including a trench 902 that is closer to the perimeter 904 of the deformable portion than to the center 906 of the deformable portion. As shown in FIG. 9, the trench 902 is positioned outside of the perimeter 904 of the deformable portion. Alternative or additionally, the trench 902 is positioned inside of the perimeter 904. In some implementations, the perimeter 904 and the trench 902 overlap one another.

The trench 902 and the perimeter 904, in some cases, overlap. The trench 902 is arranged on the actuator 900 such that the trench 902 tracks and overlaps the perimeter 904 of the deformable portion. By being positioned along the perimeter 904, the trench 902 can decrease the amount of moment that the perimeter 904 of the deformable portion can support. As a result, the deformable portion deforms a greater amount in response to a given voltage. In some implementations, an electrode, e.g., the drive electrode 316, of the actuator 900 is positioned on the exterior surface of actuator 700 and between the trench 902 and the perimeter 904 of the deformable portion. In this regard, the electrode of the actuator 900 is a circular plate having a radius approximately equal to the distance 913, e.g., having a perimeter positioned the distance 911 from the perimeter 904.

In some cases, the trench 902 defines a curve having a first end 908 and a second end 910. The first end 908 is, for example, proximate an electrical connector 912 connecting an electrode 914 to an electrical system 915 to apply voltage to the electrode 914, e.g., connecting the electrode 914 to the controller 600 and the drive 602 described with respect to FIG. 6. In this regard, the electrode 914 is positioned on the exterior surface 922 of the actuator at the center 906 of the deformable portion. The second end 910 is, for example, proximate a pumping chamber inlet 930, e.g., the pumping chamber inlet 412. The pumping chamber inlet, for example, extends through the substrate, e.g., the substrate 300, at a location proximate the second end 910 of the trench 902, to connect to a pumping chamber 932, e.g., the pumping chamber 106.

In some implementations, the trench 902 is part of a trench arrangement including the trench 902 and another trench 916. The trench arrangement includes, for example, a set of discontinuous trenches that extend such the trenches are offset from portions of the perimeter 904. The trench 902 and the trench 916, for example, define an interior region 924 on the exterior surface 922 and an exterior region 926. In some cases, the electrode 914 is positioned in the interior region 924, and the trench 902 and the trench 916 are positioned to enable the electrical connector 912 to pass from the interior region 924 to the exterior region 926. The trench 902 and the trench 916 are positioned such that the deformation of the actuator 900 along a radius extending from the center 906 sharply increases from the exterior region 926 to the interior region 924. The higher deformation is localized to regions proximate the trench and the trench 916. In this regard, in some cases, the trench 902 and the trench 916 are positioned such that the higher deformation regions are isolated from the pumping chamber inlet 930.

The trench 916 has a first end 918 and a second end 920. The first end 918 of the trench 916 is, for example, proximate the pumping chamber inlet 930, and the second end 920 of the trench 916 is, for example, proximate the electrical connector 912. The first end 918 of the trench 916 and the second end of the trench 902 define a gap on the exterior surface 922 of the actuator. The electrical connector 912 passes through the gap. The electrical connector 912 can be susceptible to damage due to deformation. The gap can reduce the deformation in the region of the electrical connector 912, thereby reducing the risk of damaging the electrical connector 912 when the actuator 900 is driven. The second end 920 of the trench 916 and the first end 908 of the trench 902 defines a gap on the exterior surface 922 of the actuator. The pumping chamber inlet 930 of the substrate extends through the substrate at a location of the gap. Deformation in the region near the pumping chamber inlet 930 can result in flow dynamics that reduce an amount of fluid ejected from the pumping chamber. This gap can reduce the deformation of the deformable portion in the region near the pumping chamber inlet 930, thereby increasing output of fluid ejected from the pumping chamber. In some implementations, the actuator 900 includes a single trench 902 in which both the first end 908 and the second end 910 of the trench are proximate the electrical connector 912 and/or the pumping chamber inlet 930.

Figure 11:
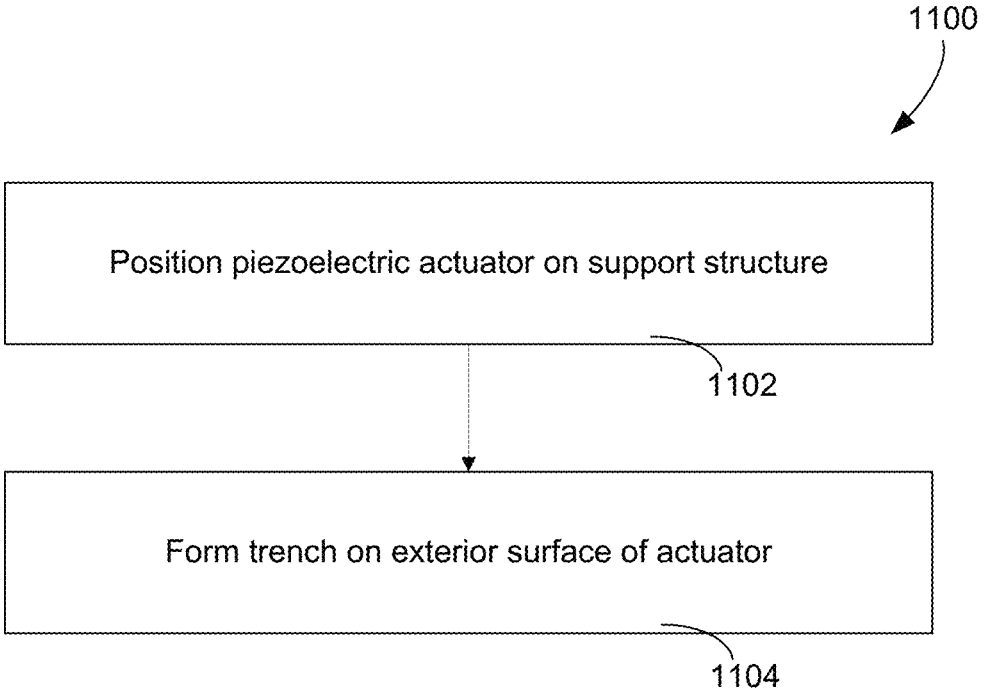
FIG. 11 is a flowchart of a process to manufacture an actuator.

FIG. 11 depicts a process 1100 to manufacture a fluid delivery system, e.g., one of the fluid delivery systems described herein including a piezoelectric actuator and a support structure. At operation 1102, a piezoelectric actuator is positioned on a support structure. At operation 1104, a trench is formed on an exterior surface of the actuator. For instance, the trench can be formed by dry or wet etching, mechanical sawing, or other processes.

A number of implementations have been described. Nevertheless, various modifications are present in other implementations.

While FIGS. 7-9 show various arrangement of the trenches formed in the exterior surface of the actuator, in other implementations, the arrangement of the trenches can vary. For example, FIGS. 12-19 show alternative arrangement of trenches. The actuators depicted in FIGS. 12-18 include support members, e.g., connectors, that connect inner portions of the actuators to outer portions of the actuators. These support members can strengthen the connection between the actuators and the underlying support structure to which the actuators are adhered. In particular, these support members can prevent delamination when the actuators are deformed. In addition, the support members can strength the actuators against breakage. For instance, the presence of the support members can prevent the central regions of the actuators from breaking.

Figure 12:
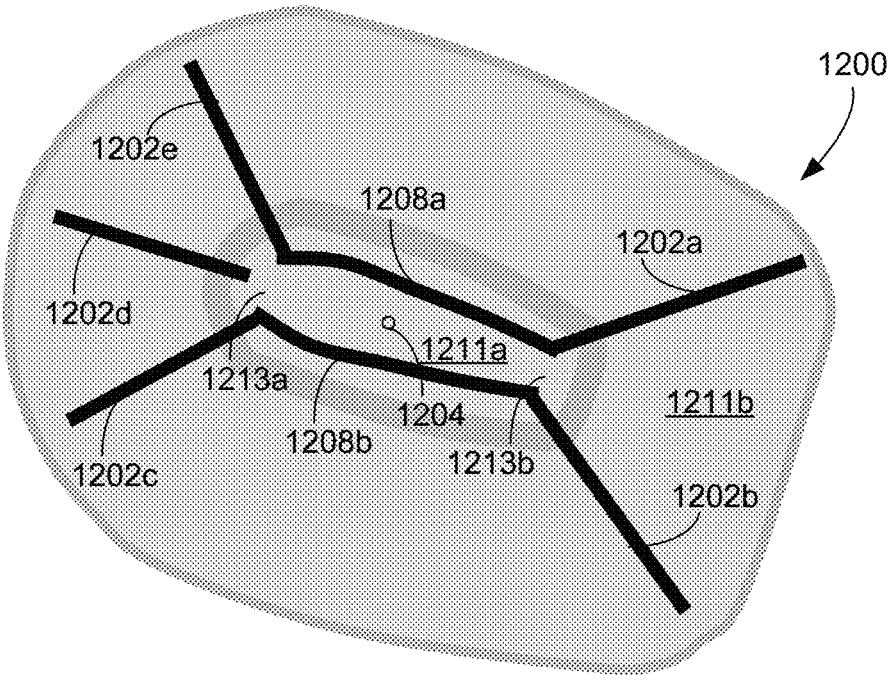
FIGS. 12-19 are top views of example actuators.

In FIG. 12, an actuator 1200 includes multiple radially extending trenches 1202*a*, 1202*b*, 1202*c*, 1202*d*, and 1202*e* (collectively referred to as trenches 1202) extending radially outward from a center 1204 of the actuator 1200. In some examples, the distribution of the radially extending trenches 1202 about the actuator 1200 can be similar to the distribution of the radially extending trenches 702 described with respect to FIG. 7. The actuator 1200 includes one or more circumferentially extending trenches 1208*a*, 1208*b* connecting the radially extending trenches 1202 to one another. Unlike the trench 708 of the actuator 700 that forms a closed loop around the center 1204 of the actuator 1200, the trenches 1208*a*, 1208*b* do not connect to each other. In this regard, the actuator 1200 does not include a trench that is a continuous loop. In the example of FIG. 12, the circumferentially extending trench 1208*a* is connected to the radially extending trenches 1202*a*, 1202*e*, and the circumferentially extending trench 1208*b* is connected to the radially extending trenches 1202*b*, 1202*c*; however, other arrangements are also possible. As shown in FIG. 12, in some implementations, one or more of the trenches, e.g., the trench 1202*d*, is not connected to any of the other radially extending trenches 1202*b-e* and is not connected to any of the other circumferentially extending trenches, e.g., the trenches 1208*a*, 1208*b*.

Because the actuator 1200 does not include a trench forming a continuous loop, a central inner portion 1211*a* of the actuator 1200 is connected to an outer portion 1211*b* of the actuator 1200 by connectors 1213*a*, 1213*b* that extend between the trenches 1208*a*, 1208*b*. In the example of FIG. 12, the connector 1213*a* separates the trench 1202*d* from the trenches 1208*a*, 1202*b*, and the connectors 1213*a*, 1213*b* further separate the trenches 1208*a*, 1208*b* from one another; however, the connectors can also be placed in other positions relative to the trenches. By being connected to the outer portion 1211*b*, the central portion 1211*a* can more easily remain attached to the underlying support structure because of the support provided by the connectors 1213*a*, 1213*b* connecting the central portion 1211*a* to the outer portion 1211*b*. In some implementations, widths of the connectors 1213*a*, 1213*b* are between 0.5 and 10 times a width of the trenches of the actuator 1200, which have widths similar to other trenches described herein.

Figure 13:
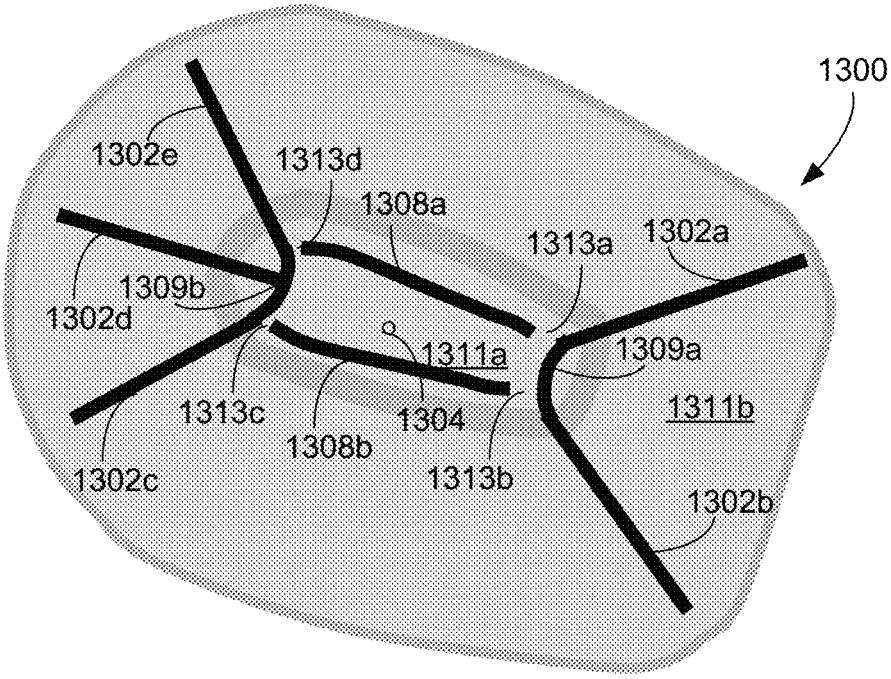

In FIG. 13, an actuator 1300 includes multiple radially extending trenches 1302*a*, 1302*b*, 1302*c*, 1302*d*, and 1302*e* (collectively referred to as trenches 1302) extending radially outward from a center 1304 of the actuator 1300. In some examples, the actuator 1300 differs from the actuator 1200 in that circumferentially extending trenches 1308*a*, 1308*b* do not connect each other and are separated from the radially extending trenches 1302. In some examples, unlike the trenches 1202 of the actuator 1200, each of the radially extending trenches 1302 can be connected to at least one of the other radially extending trenches 1302. The actuator 1300 includes connecting trenches 1309*a*, 1309*b* that connect the radially extending trenches 1302 to one another. For example, the connecting trench 1309*b* connects the radially extending trenches 1302*a*, 1302*b* to one another, and the connecting trench 1309*a* connects the radially extending trenches 1302*c*-1302*e* to one another; however, other arrangements are possible. In some implementations, the connecting trenches 1309*a*, 1309*b* are circumferentially extending trenches, while, in other implementations, the connecting trenches 1309*a*, 1309*b* curve away from a center 1304 of the actuator 1300.

In some examples, like the central portion 1211*a* of the actuator 1200, a central portion 1311*a* of the actuator 1300 can be connected to an outer portion 1311*b* of the actuator 1300 by connectors 1313*a*, 1313*b*, 1313*c*, 1313*d*. The connector 1313*a* extends between the trench 1308*a* and the connecting trench 1309*a*, the connector 1313*b* extends between the trench 1308*b* and the connecting trench 1309*a*, the connector 1313*c* extends between the trench 1308*b* and the connecting trench 1309*b*, and the connector 1313*d* extends between the trench 1308*a* and the connecting trench 1309*b*. By being connected to the outer portion 1311*b*, the central portion 1311*a* can more easily remain attached to the underlying support structure because of the support provided by the connectors 1313*a*, 1313*b*, 1313*c*, 1313*d* connecting the central portion 1311*a* to the outer portion 1311*b*.

Figure 14:
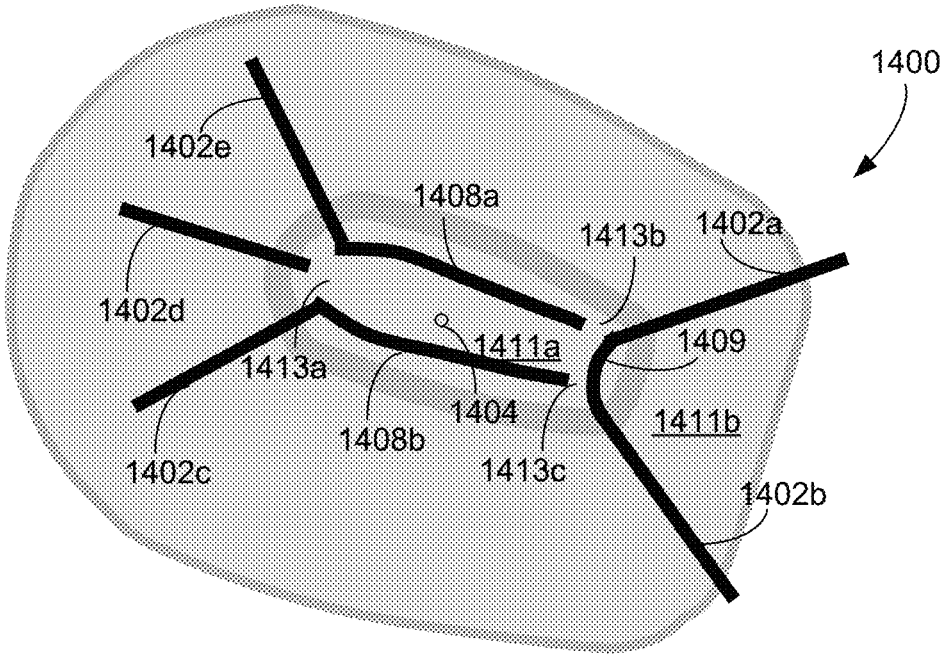

In FIG. 14, an actuator 1400 includes multiple radially extending trenches 1402*a*, 1402*b*, 1402*c*, 1402*d*, and 1402*e* (collectively referred to as trenches 1402) extending radially outward from a center 1404 of the actuator 1400. In some examples, the actuator 1400 can be similar to the actuator 1300 in that circumferentially extending trenches 1408*a*, 1408*b* are discontinuous relative to one another. In some examples, unlike the circumferentially extending trenches 1308*a*, 1308*b* of the actuator 1300, the trenches 1408*a*, 1408*b* can be each connected to at least one of the radially extending trenches 1402. For example, the radially extending trench 1402*e* is connected to the circumferentially extending trench 1408*a*, and the radially extending trench 1402*c* is connected to the circumferentially extending trench 1408*b*. The radially extending trenches 1402*a*, 1402*b* are connected to one another by a connecting trench 1409. As shown in FIG. 14, the radially extending trench 1402*d* is not connected to any other radially extending trench, nor is it connected to any of the circumferential trenches 1408*a*. With this arrangement of trenches, connectors 1413*a*, 1413*b*, 1413*c* connect a central inner portion 1411*a* of the actuator 1400 to an outer portion 1411*b* of the actuator 1400. The connector 1413*a* separates the radially extending trench 1402*d* from the circumferential trenches 1408*a*, 1408*b* and separates the circumferential trenches 1408*a*, 1408*b* from one another. The connector 1413*b* separates the trenches 1402*a*, 1402*b*, and the connecting trench 1409 from the circumferential trench 1408*a*, and the connector 1413*c* separates the trenches 1402*a*, 1402*b* and the connecting trench 1409 from the circumferential trench 1408*b*

Figure 15:
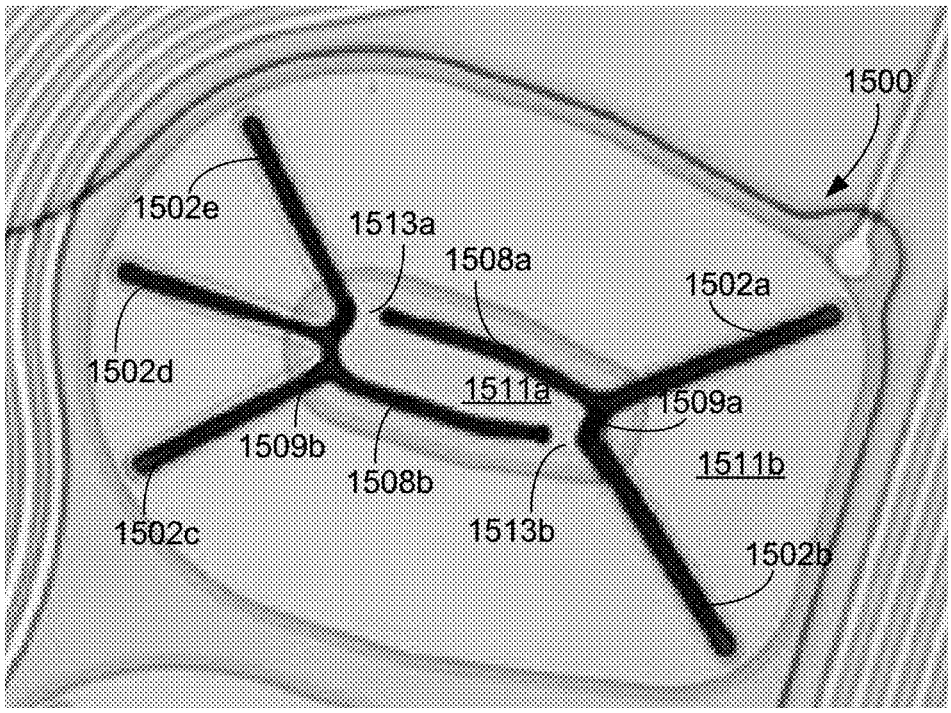

In the example of FIG. 15, an actuator 1500 differs from the actuator 1400 in that a circumferential trench 1508*a* is connected to a connecting trench 1509*a*, which in turn connects the circumferential trench 1508*a* to the radially extending trenches 1502*a*, 1502*b*. These trenches form a first set of trenches. A circumferential trench 1508*b* is connected to a connecting trench 1509*b*, which in turn connects the circumferential trench 1508*b* to the radially extending trenches 1502*c*, 1502*d*, 1502*e*. These trenches form a second set of trenches. In some examples, like the circumferential trenches 1408*a*, 1408*b* of the actuator 1400, the circumferential trenches 1508*a*, 1508*b* can be separated from one another. In this regard, the first set of trenches is separated from the second set of trenches. Connectors 1513*a*, 1513*b* connect a central inner portion 1511*a* of the actuator 1500 from an outer portion 1511*b* of the actuator 1500 and separate the first set of trenches from the second set of trenches.

Figure 16:
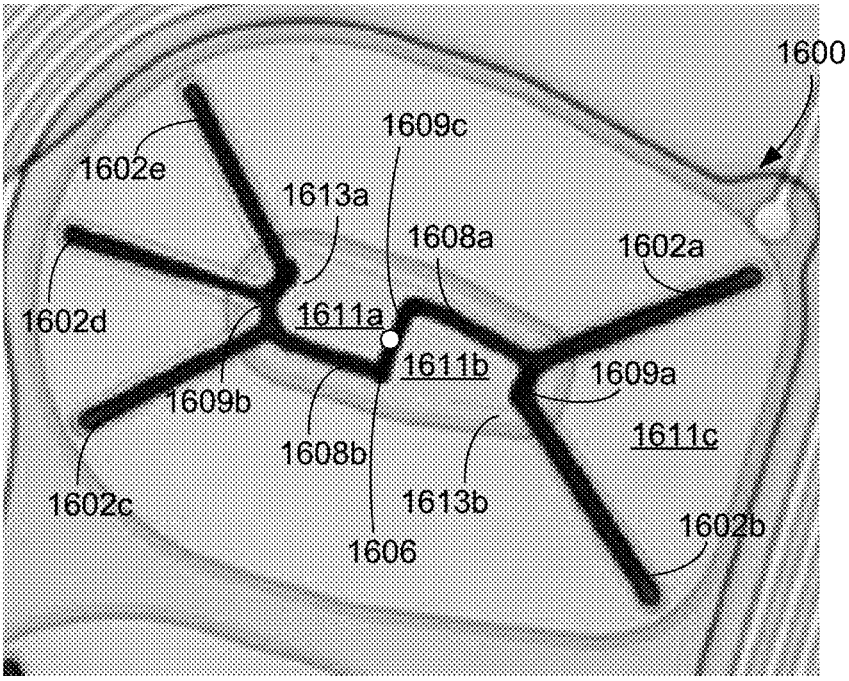

In the example of FIG. 16, an actuator 1600 differs from the actuator 1500 in that the actuator 1600 includes a connecting trench 1609*c* connecting a first set of trenches to a second set of trenches. The first set of trenches includes a circumferential trench 1608*a* directly connected to a connecting trench 1609*a* connecting the circumferential trench 1608*a* to radially extending trenches 1602*a*, 1602*b*. The second set of trenches includes a circumferential trench 1608*b* directly connected to a connecting trench 1609*b* connecting the circumferential trench 1608*b* to radially extending trenches 1602*c*, 1602*d*, 1602*e*. The connecting trench 1609*c* directly connects the circumferential trench 1608*a* to the circumferential trench 1608*b*, thereby connecting the first set of trenches to the second set of trenches. In some implementations, the connecting trench 1609*c* extends through a center 1606 of the actuator 1600, extending radially outward from the center 1606 in multiple radial directions to the circumferential trenches 1608*a*, 1608*b*. In this regard, connectors 1613*a*, 1613*b* have a width greater than a width of the connectors 1513*a*, 1513*b*, e.g., 2 to 15 times greater than a width of the connectors 1513*a*, 1513*b*. Furthermore, unlike the inner portion 1511*a* of the actuator 1500, an inner portion of the actuator 1600 is divided into a first inner portion 1611*a* separated from a second inner portion 1611*b* by the connecting trench 1609*c*. The connector 1613*a* connects the first inner portion 1611*a* to an outer portion 1611*c* of the actuator 1600, and the connector 1613*b* connects the second inner portion 1611*b* to the outer portion 1611*c*.

Figure 17:
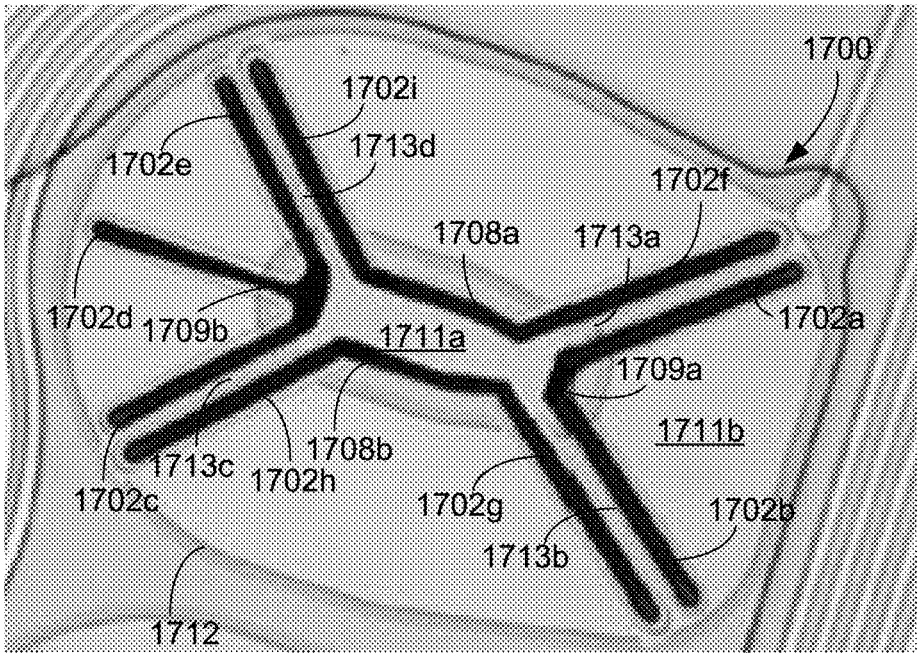

In the example of FIG. 17, an actuator 1700 includes radially extending trenches 1702*a*-1702*i* and connecting trenches 1709*a*, 1709*b*. In some examples, the radially extending trenches 1702*a*-1702*e* can be similar to the radially extending trenches 1302*a*-1302*e* described with respect to FIG. 13, and the connecting trenches 1709*a*, 1709*b* are similar to the connecting trenches 1309*a*, 1309*b*. Similar to the circumferential trenches 1308*a*, 1308*b*, circumferential trenches 1708*a*, 1708*b* are separated from the radially extending trenches 1702*a*-1702*e*. In some examples, unlike the circumferential trenches 1308*a*, 1308, the circumferential trenches 1708*a*, 1708*b* can be connected to the radially extending trenches 1702*f*-1702*i*. In particular, the circumferential trench 1708*a* is connected to the radially extending trench 1702*f* and the radially extending trench 1702*i*, and the circumferential trench 1708*b* is connected to the radially extending trench 1702*g* and the radially extending trench 1702*h*. The radially extending trench 1702*f*-1702*i* extend radially outward parallel to the radially extending trenches 1702*a*-1702*c*, 1702*e*, respectively. Connectors 1713*a*-1713*d* are positioned between the radially extending trench 1702*f*-1702*i* and radially extending trenches 1702*a*-1702*c*, 1702*e* and connect a central inner portion 1711*a* of the actuator 1700 to an outer portion 1711*b* of the actuator 1700. In this regard, the connectors 1713*a*-1713*d* extend radially outward and terminate proximate to a perimeter 1612 of the actuator 1700.

Figure 18:
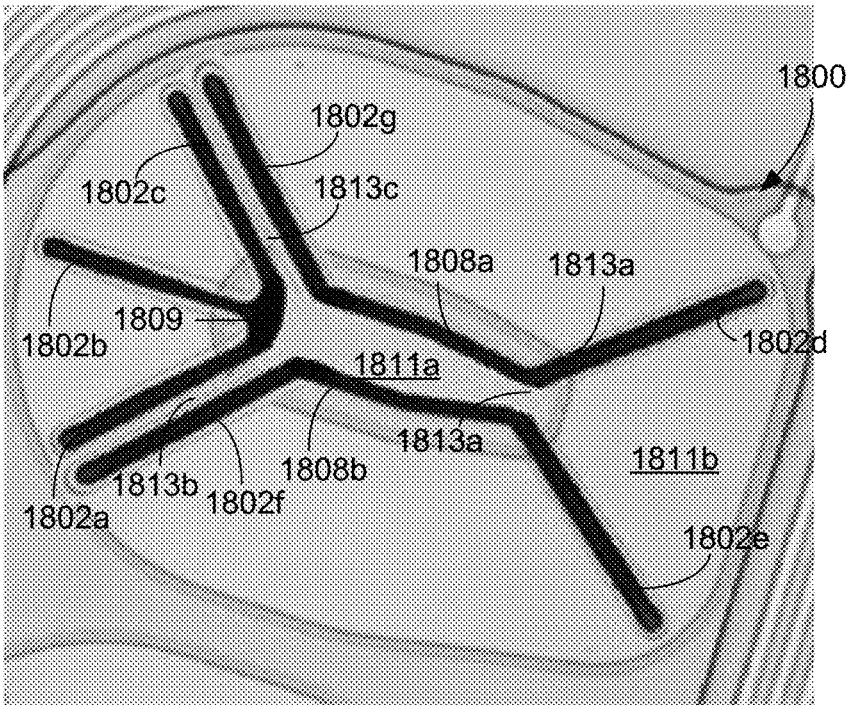

In the example of FIG. 18, an actuator 1800 includes radially extending trenches 1802*a*-1802*g* similar to radially extending trenches 1702*c*-1702*i* of the actuator 1700. In some examples, the actuator 1800 can include circumferential trenches 1808*a*, 1808*b* similar to the circumferential trenches 1708*a*, 1708*b*. In some examples, the actuator 1800 does not include a connecting trench similar to the connecting trench 1709*a* of the actuator 1700 and includes a connecting trench 1809 similar to the connecting trench 1708*b* of the actuator 1700. The actuator 1800 can differ from the actuator 1700 in that the actuator 1800 does not include trenches similar to the radially extending trenches 1702*a*, 1702*b* of the actuator 1700. As a result, while the actuator 1800 includes connectors 1813*b*, 1813*c* similar to connectors 1713*c*, 1713*d* of the actuator 1700, the actuator 1800 does not include connectors similar to connectors 1713*a*, 1713*b*. Rather the actuator 1800 includes a connector 1813*a* connecting an inner portion 1811*a* of the actuator 1800 to an outer portion 1811*b* of the actuator 1800. The connector 1813*a* is similar to the connector 1213*b* of the actuator 1200.

Figure 19:
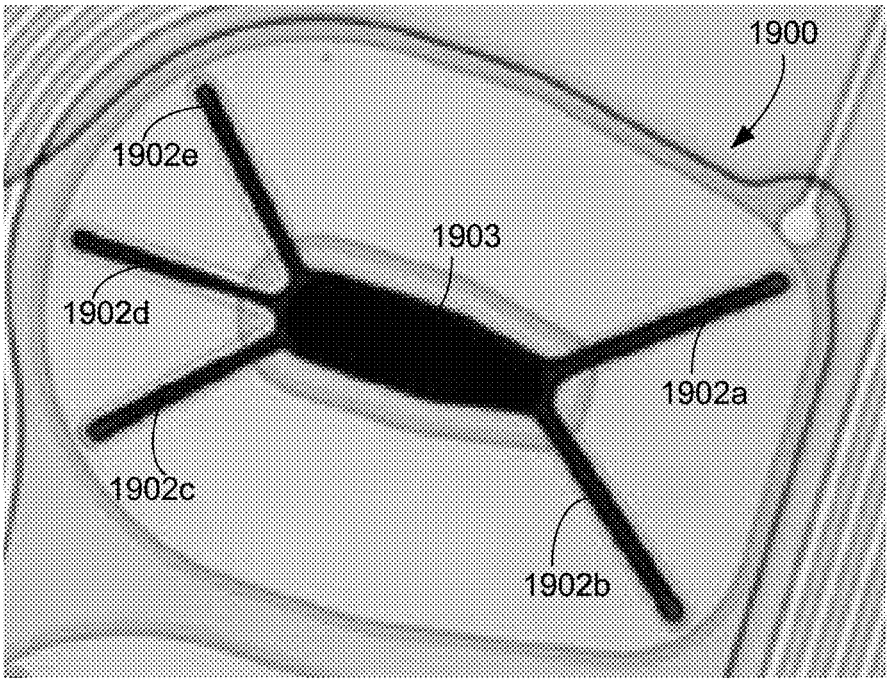

FIG. 19 shows an example of an actuator 1900 including radially extending trenches 1902*a*, 1902*b*, 1902*c*, 1902*d*, 1902*e* (collectively referred to as radially extending trenches 1902) that are similar to the radially extending trenches 1202*a*-1202*e* of the actuator 1200. In some examples, unlike the trenches 1202, the trenches 1902 are connected to one another by a central trench 1903. Instead of including a central inner portion like the central inner portion 1211*a* of the actuator 1200, the actuator 1900 includes the central trench 1903 that connects the radially extending trenches 1902 to one another. As a result, the actuator 1900 does not include a central inner portion that could be at risk of delaminating from the underlying support structure.

The actuators described herein are, in some implementations, unimorphs. In this regard, an actuator in such implementations includes a single active layer and a single inactive layer. The actuator 108, for example, includes the support structure 102. In this regard, the piezoelectric layer 314 corresponds to the active layer, and the support structure 102, e.g., the deformable portion 104 of the support structure 102, corresponds to the inactive layer.

In one specific example, a printhead has a feed channel (e.g., an inlet feed channel 304 or an outlet feed channel 408) that serves 16 fluid ejectors (hence there are 16 menisci associated with the feed channel). The feed channel has a width of 0.39 mm, a depth of 0.27 mm, and a length of 6 mm. The thickness of the silicon nozzle layer 312 is 30 μm and the modulus of the nozzle layer 312 is 186E9 Pa. The radius of each meniscus is between, for example, 7 and 25 μm. A typical bulk modulus for a water-based inks is about B=2E9 Pa and a typical surface tension is about 0.035 N/m.

Accordingly, other implementations are within the scope of the claims.

What is claimed is:

1. A printhead comprising:

a support structure comprising a deformable portion, an outer perimeter of the deformable portion defining an outer perimeter of a top surface of a pumping chamber; and an actuator disposed on the deformable portion of the support structure, wherein a trench is defined in a top surface of the actuator, the trench defining at least a portion of a loop offset inwardly from the outer perimeter of the deformable portion, wherein an entirety of the trench is within the outer perimeter of the deformable portion.

2. The printhead of claim 1, wherein application of a voltage to the actuator causes the actuator to deform along the trench, thereby causing deformation of the deformable portion to eject a drop of fluid from the pumping chamber.

3. The printhead of claim 1, comprising multiple radial trenches each extending radially outward away from a central region of the top surface of the actuator.

4. The printhead of claim 3, wherein each of the radial trenches is oriented perpendicular to the trench at a point where the radial trench meets the trench.

5. The printhead of claim 1, wherein a distance between the trench and the outer perimeter of the deformable portion is greater than a distance between the trench and a central region of the top surface of the deformable portion.

6. The printhead of claim 1, wherein a distance between the trench and the outer perimeter of the deformable portion is less than a distance between the trench and a central region of the top surface of the deformable portion.

7. The printhead of claim 1, wherein the trench is a first trench, and further comprising a second trench defined in the top surface of the actuator, the second trench extending radially outward from the first trench.

8. The printhead of claim 7, wherein a first end of the second trench is connected to the first trench and a second end of the second trench is connected to a third trench defined in the top surface of the actuator, wherein the third trench has a rounded shape.

9. The printhead of claim 1, wherein a width of the trench is between 0.1 micrometers and 10 micrometers.

10. The printhead of claim 1, wherein the trench extends through a thickness of the actuator from the top surface of the actuator to a top surface of the deformable portion of the support structure.

11. The printhead of claim 1, wherein the trench is a first trench, and the loop is a first loop, and wherein a second trench is formed in the top surface of the actuator, the second trench defining at least a portion of a second loop separated from the first loop.

12. The printhead of claim 1, wherein the trench is a first trench, and wherein a second trench is formed in the top surface of the actuator further, the first trench and the second trench extending radially outward away from a central region of the top surface of the actuator and being parallel to one another.

13. An apparatus comprising:

a reservoir; and a printhead comprising a support structure comprising a deformable portion, an outer perimeter of the deformable portion defining an outer perimeter of a top surface of a pumping chamber, a flow path extending from the reservoir to the pumping chamber to transfer fluid from the reservoir to the pumping chamber, and an actuator disposed on the deformable portion of the support structure, wherein a trench is defined in a top surface of the actuator, the trench defining at least a portion of a loop offset inwardly from the outer perimeter of the deformable portion, wherein an entirety of the trench is within the outer perimeter of the deformable portion, wherein application of a voltage to the actuator causes the actuator to deform along the trench, thereby causing deformation of the deformable portion of the support structure to eject a drop of fluid from the pumping chamber.

14. A printhead comprising:

a support structure comprising a deformable portion, an outer perimeter of the deformable portion defining an outer perimeter of a top surface of a pumping chamber; and an actuator disposed on the deformable portion of the support structure, where the outer perimeter of the deformable portion is aligned with the outer perimeter of the pumping chamber, and wherein a trench is defined in a top surface of the actuator, wherein an entirety of the trench is within the outer perimeter of the deformable portion.

15. The printhead of claim 14, wherein application of a voltage to the actuator causes the actuator to deform along the trench, thereby causing deformation of the deformable portion to eject a drop of fluid from the pumping chamber.

16. The printhead of claim 14, wherein the trench extends radially outwardly away from a central region of the top surface of the actuator.

17. The printhead of claim 14, comprising multiple radial trenches each extending radially outward away from a central region of the top surface of the actuator.

18. The printhead of claim 17, wherein each of the radial trenches is oriented perpendicular to the trench at a point where the radial trench meets the trench.

19. The printhead of claim 14, wherein a distance between the trench and the outer perimeter of the deformable portion is greater than a distance between the trench and a central region of the top surface of the deformable portion.

20. The printhead of claim 14, wherein a distance between the trench and the outer perimeter of the deformable portion is less than a distance between the trench and a central region of the top surface of the deformable portion.

21. The printhead of claim 14, wherein the trench defines at least a portion of a loop offset inwardly from a portion of the outer perimeter of the deformable portion.

22. The printhead of claim 14, wherein the trench is a first trench, and further comprising a second trench defined in the top surface of the actuator, the second trench extending radially outward from the first trench.

23. The printhead of claim 22, wherein a first end of the second trench is connected to the first trench and a second end of the second trench is connected to a third trench defined in the top surface of the actuator, wherein the third trench has a rounded shape.

24. The printhead of claim 14, wherein a width of the trench is between 0.1 micrometers and 10 micrometers.

25. The printhead of claim 14, wherein the trench extends through a thickness of the actuator from the top surface of the actuator to a top surface of the deformable portion of the support structure.

26. The printhead of claim 14, wherein the trench overlaps with at least a portion of the outer perimeter of the deformable portion.

27. The printhead of claim 14, wherein the trench is a first trench defining at least a portion of a first loop, and wherein a second trench is formed in the top surface of the actuator, the second trench defining at least a portion of a second loop separated from the first loop.

* * * * *